US010320094B2

(12) United States Patent
Honda

(10) Patent No.: US 10,320,094 B2
(45) Date of Patent: Jun. 11, 2019

(54) MULTI-BAND DUAL POLARIZATION OMNI-DIRECTIONAL ANTENNA

(71) Applicant: LHC2 INC, Liberty Lake, WA (US)

(72) Inventor: Royden M. Honda, Post Falls, ID (US)

(73) Assignee: LHC2 INC, Liberty Lake, WA (US)

( * ) Notice: Subject to any disclaimer, the term of this patent is extended or adjusted under 35 U.S.C. 154(b) by 121 days.

(21) Appl. No.: 15/396,321

(22) Filed: Dec. 30, 2016

(65) Prior Publication Data

US 2017/0194718 A1 Jul. 6, 2017

Related U.S. Application Data

(60) Provisional application No. 62/274,019, filed on Dec. 31, 2015.

(51) Int. Cl.

| | |
|---|---|
| ***H01Q 21/24*** | (2006.01) |
| ***H01Q 1/22*** | (2006.01) |
| ***H01Q 15/14*** | (2006.01) |
| ***H01Q 5/40*** | (2015.01) |

(52) U.S. Cl.

CPC ..... *H01Q 21/24* (2013.01); *H01Q 1/2291* (2013.01); *H01Q 5/40* (2015.01); *H01Q 15/14* (2013.01)

(58) Field of Classification Search

CPC ..... H01Q 15/14; H01Q 1/2291; H01Q 21/24; H01Q 5/30; H01Q 5/40

See application file for complete search history.

(56) References Cited

U.S. PATENT DOCUMENTS

| | | | | |
|---|---|---|---|---|
| 3,810,185 A * | 5/1974 | Wilkinson | H01Q 19/195 | 343/756 |
| 4,829,312 A * | 5/1989 | Terakawa | H01Q 1/40 | 343/756 |
| 4,841,308 A * | 6/1989 | Terakawa | H01Q 13/0233 | 343/771 |
| 5,270,724 A * | 12/1993 | Ajioka | H01Q 21/061 | 343/725 |
| 5,461,392 A * | 10/1995 | Mott | H01Q 13/085 | 343/705 |
| 5,748,153 A * | 5/1998 | McKinzie, III | H01Q 13/08 | 343/767 |
| 9,614,290 B1 * | 4/2017 | Remski | H01Q 21/064 | |

* cited by examiner

*Primary Examiner* — Tho G Phan

(74) *Attorney, Agent, or Firm* — Lee & Hayes, P.C.

(57) ABSTRACT

A horizontally polarized antenna may be mounted or operated with a vertical axis of the antenna being substantially perpendicular to a plane defined by the surface of the earth, and still emanate an electric field that is parallel to the surface of the earth. Use of horizontal polarization may improve communications reliability by reducing interference from predominantly vertically polarized signals in overlapping and adjacent frequency bands. Also, a vertically polarized antenna may be mounted or operated with a vertical axis of the antenna being substantially vertical to a plane defined by the surface of the earth, and still emanate an electric field that is vertical to the surface of the earth. A horizontally polarized antenna and a vertically polarized antenna mounted with their vertical axes collinearly aligned, but both antennae physically separated, provide a compact dual polarized unit emanating vertical and horizontal polarized electric fields.

5 Claims, 55 Drawing Sheets

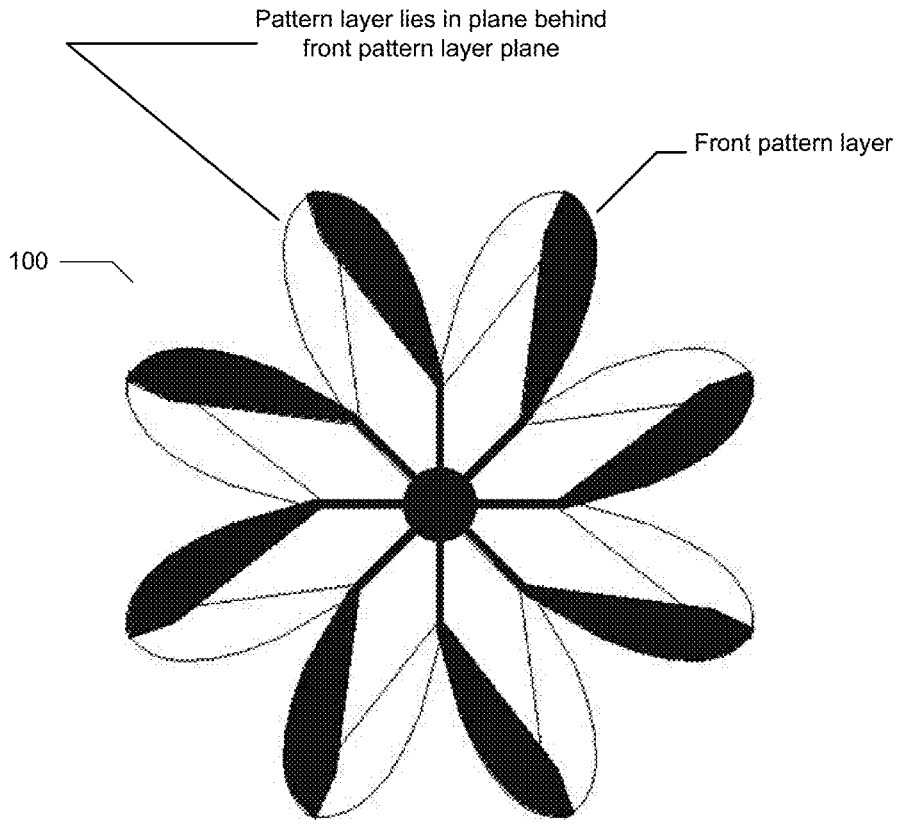
Figure 1H . Lotus Horizontal Polarization Omni-Directional Antenna

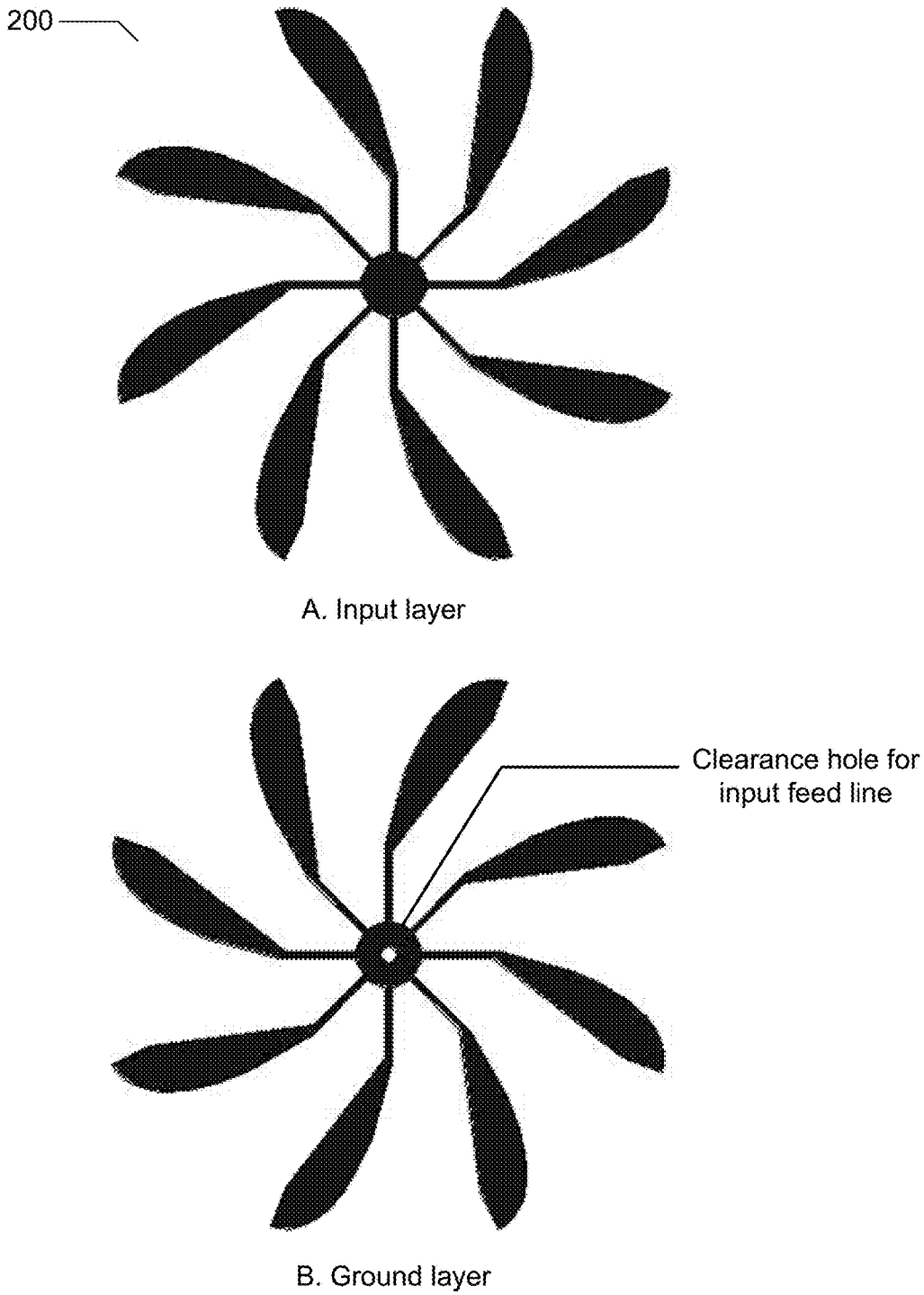
Figure 2H. Lotus petal layers – Radial line excitation method

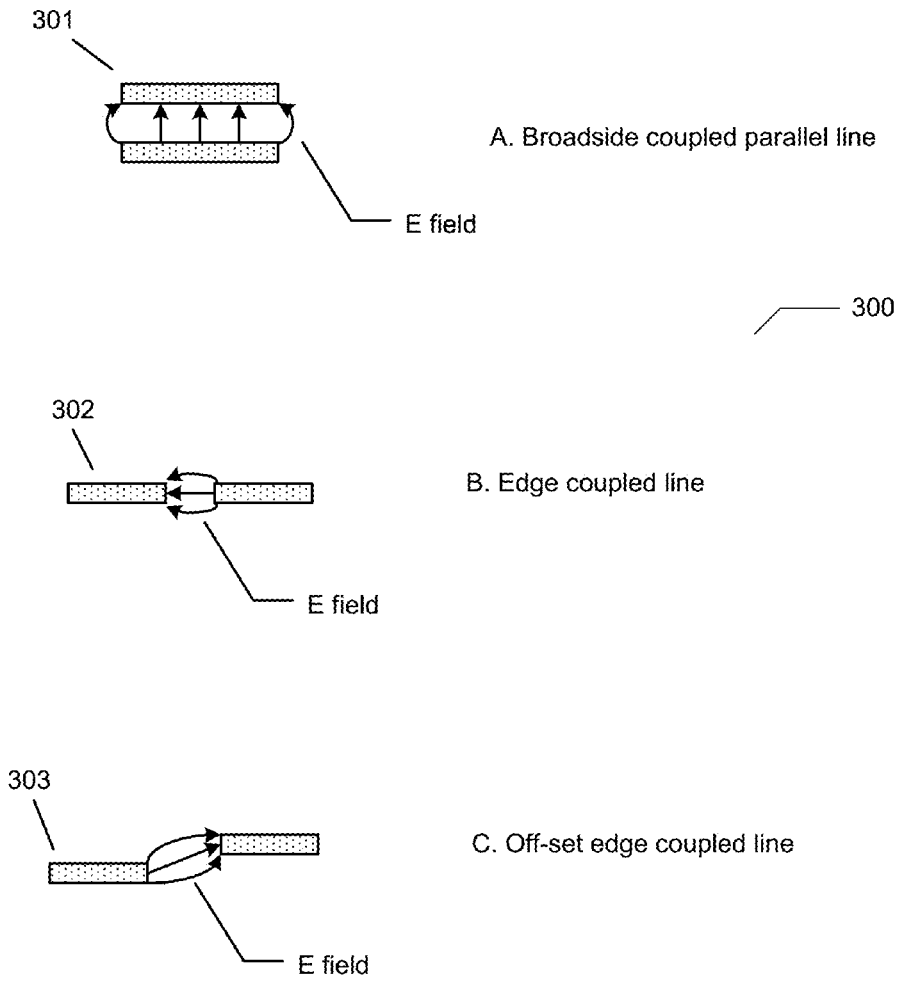
Figure 3H. Transmission lines integral to the Lotus antenna design

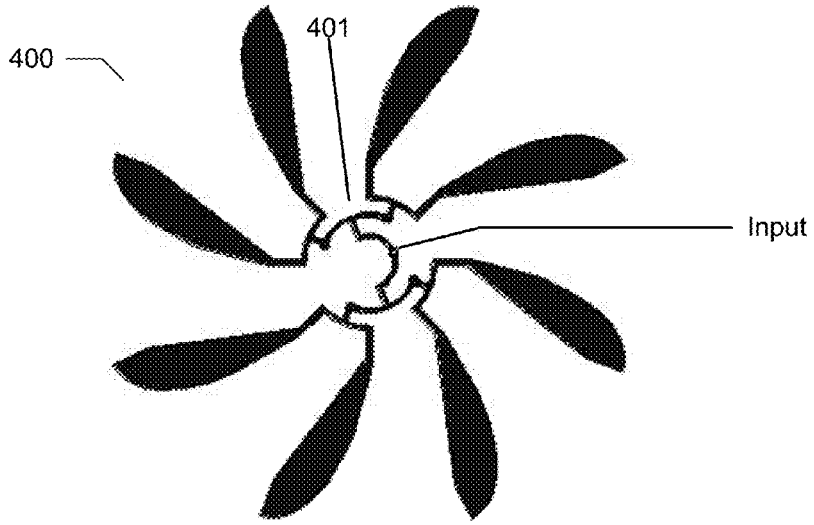
A. Input layer
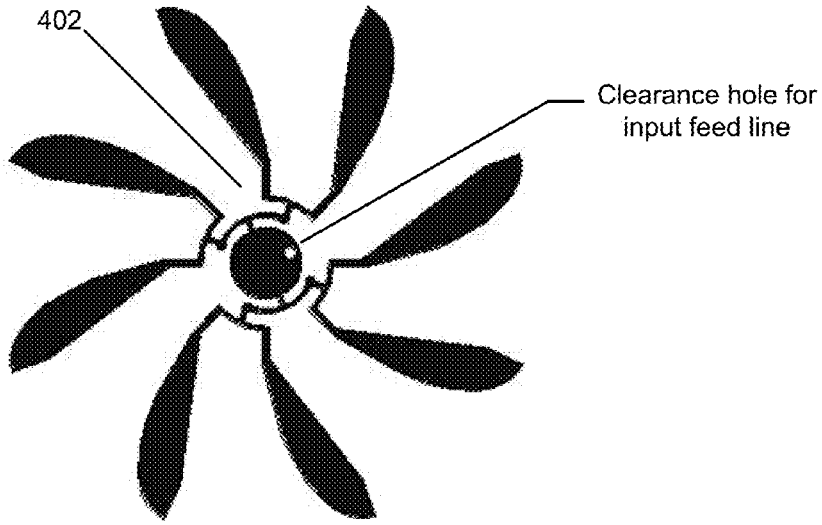
B. Ground layer
Figure 4H. Lotus petal layers – corporate feed excitation

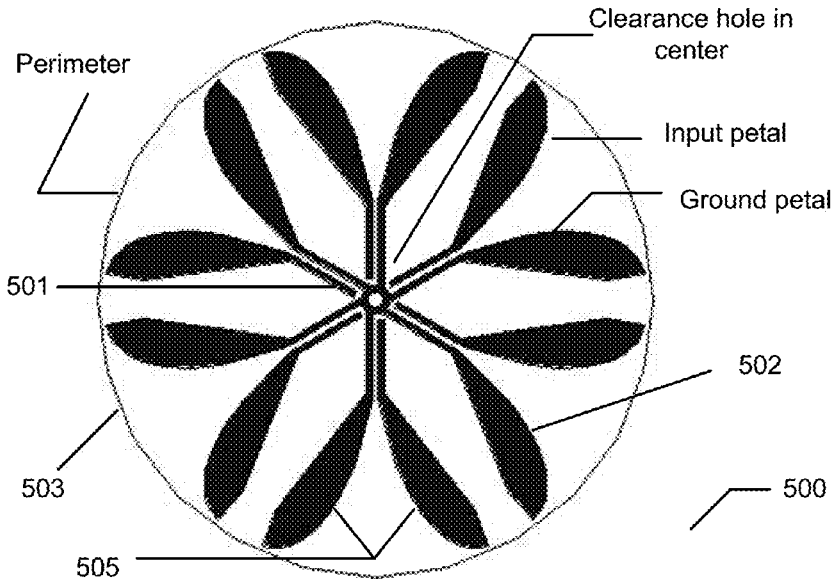
A. Lotus petals – antenna layer
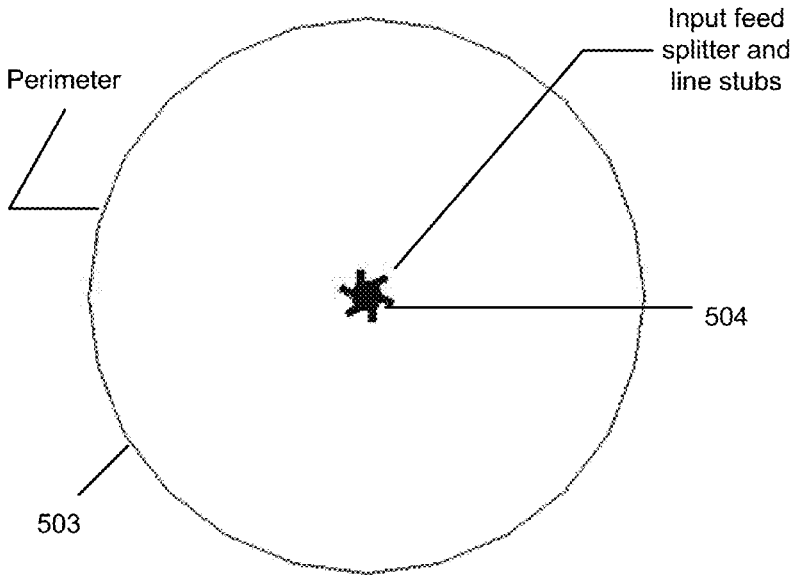
B. Input feed splitter – input layer
Figure 5H. Lotus petal layer – edge coupled line excitation

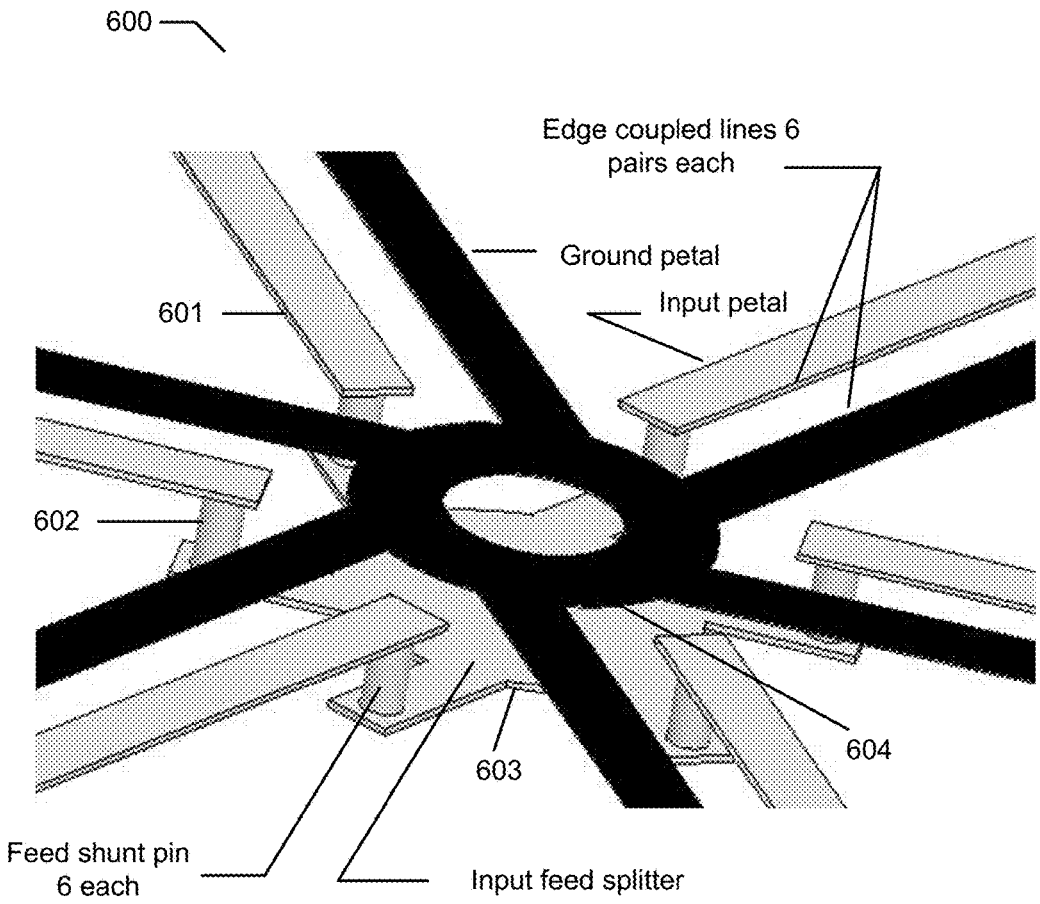
Figure 6H. Enlarged perspective view of edge coupled line feed network

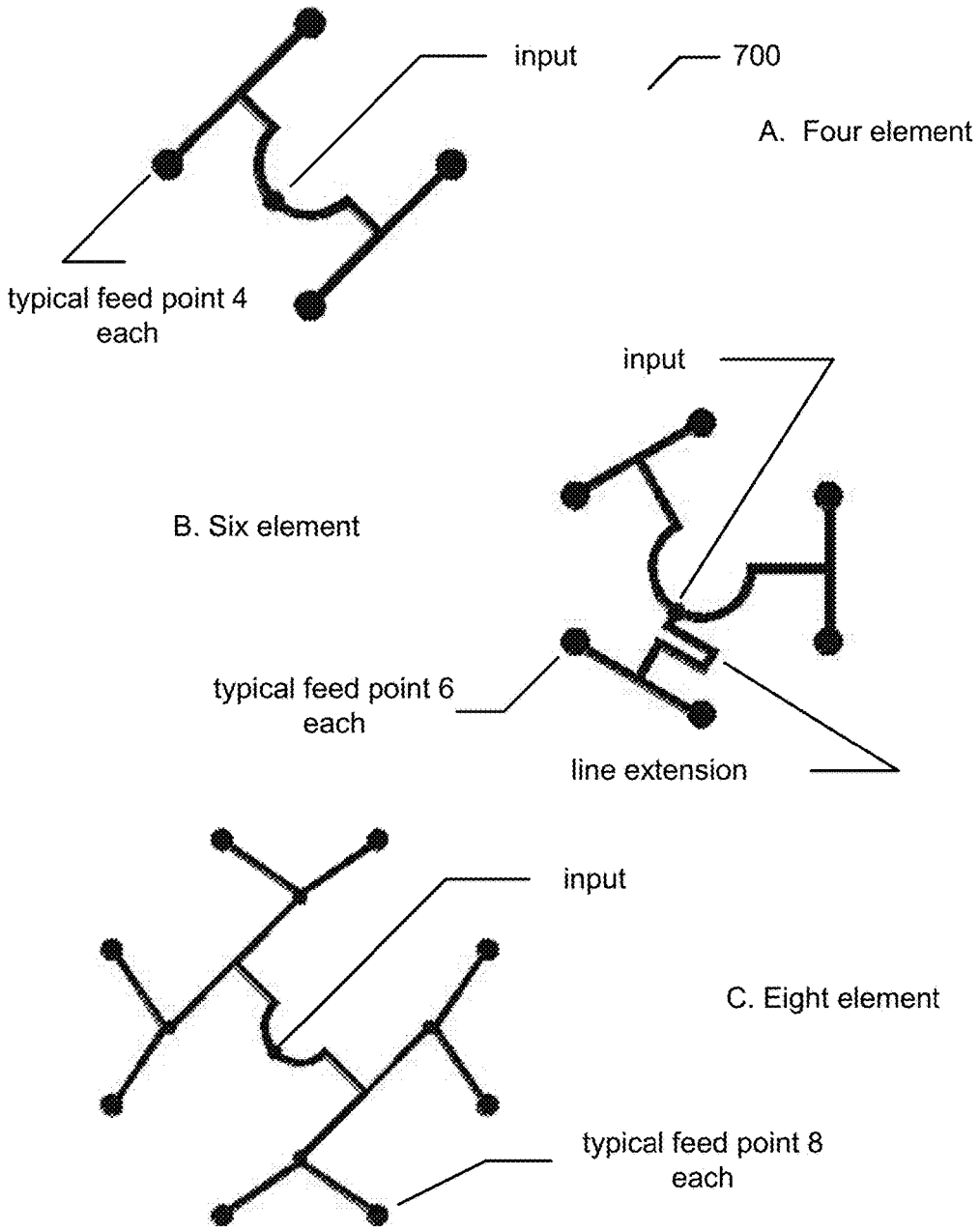
Figure 7H. Examples of corporate feed configurations

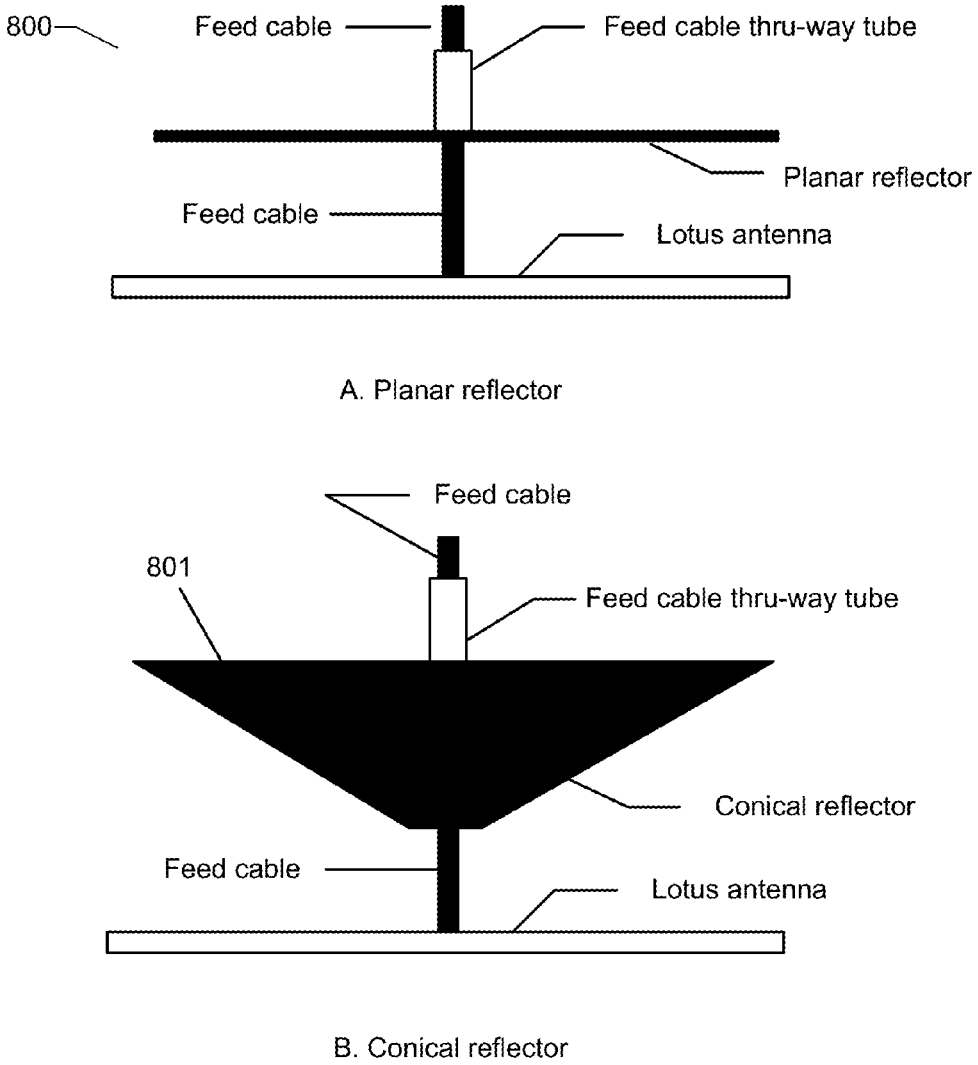
Figure 8H. Beam tilting reflectors with the Lotus antenna

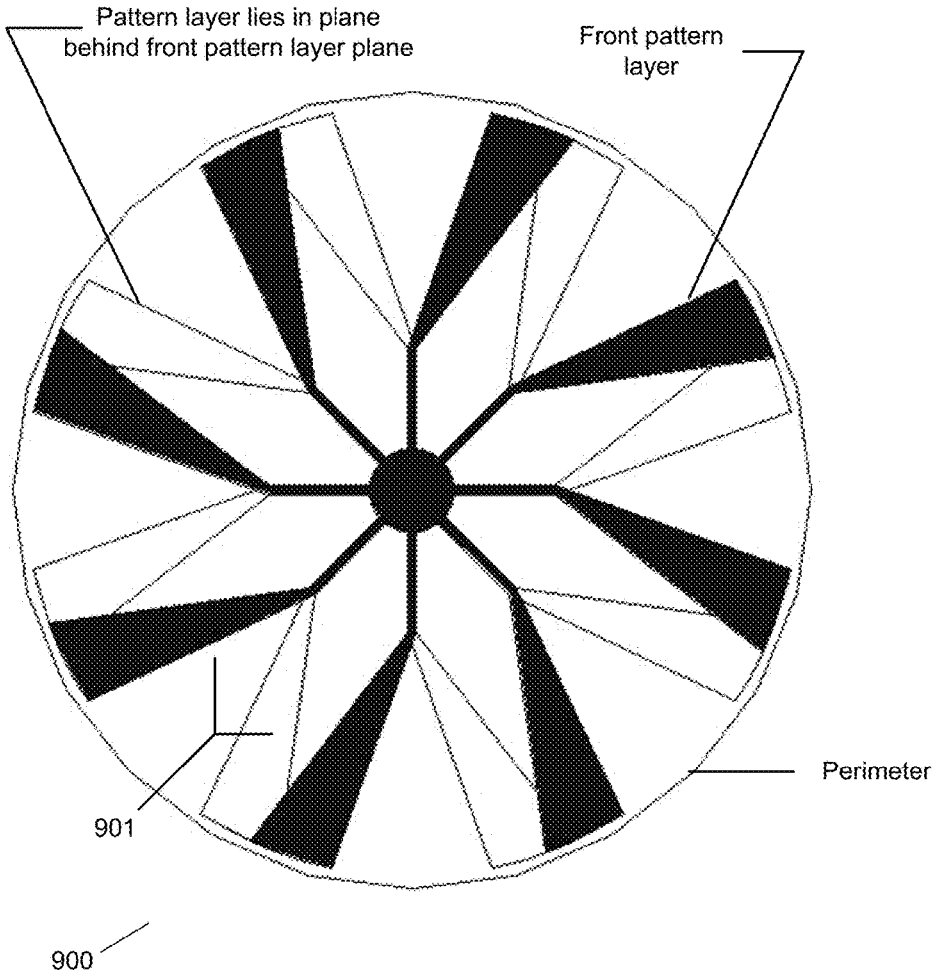
Figure 9H. Two-layer flared aperture horizontal polarization omni-directional antenna. Linear flare.

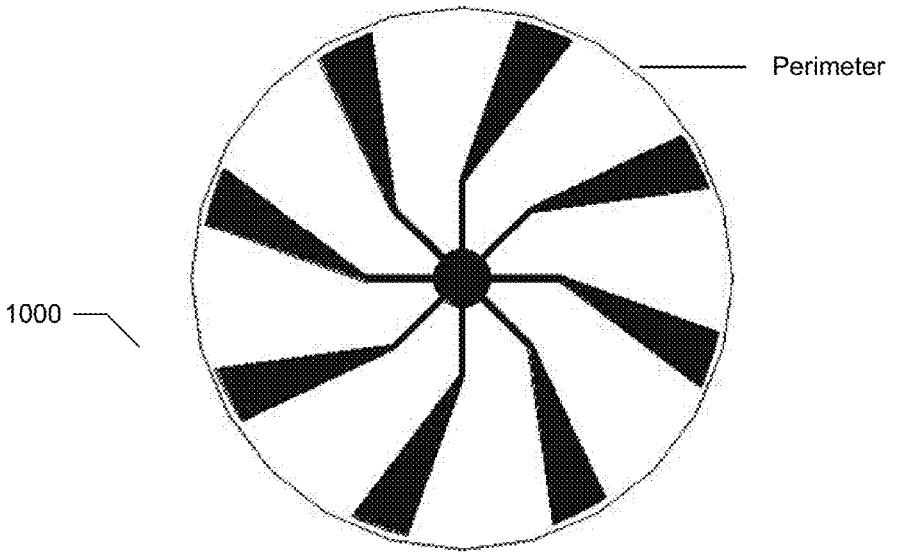
A. Electrically conductive pattern.
Layer 1
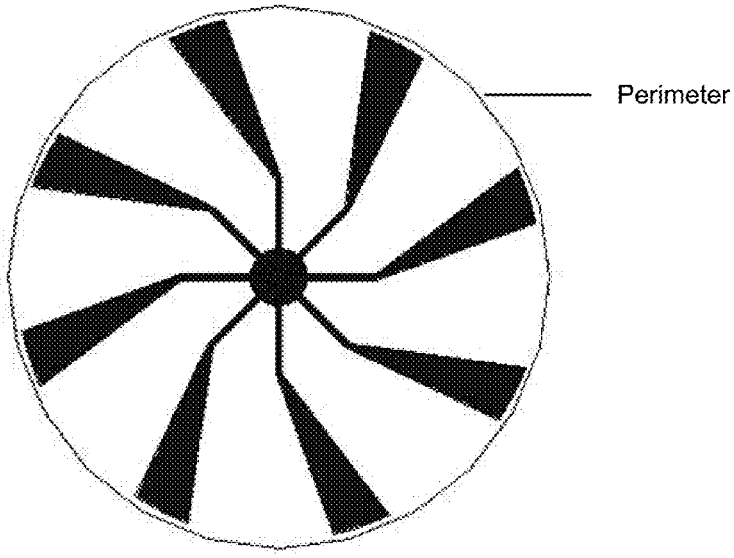
B. Electrically conductive pattern. Layer 2
Figure 10H. Two-layer flared aperture horizontal polarization omni-directional antenna. Linear flare.

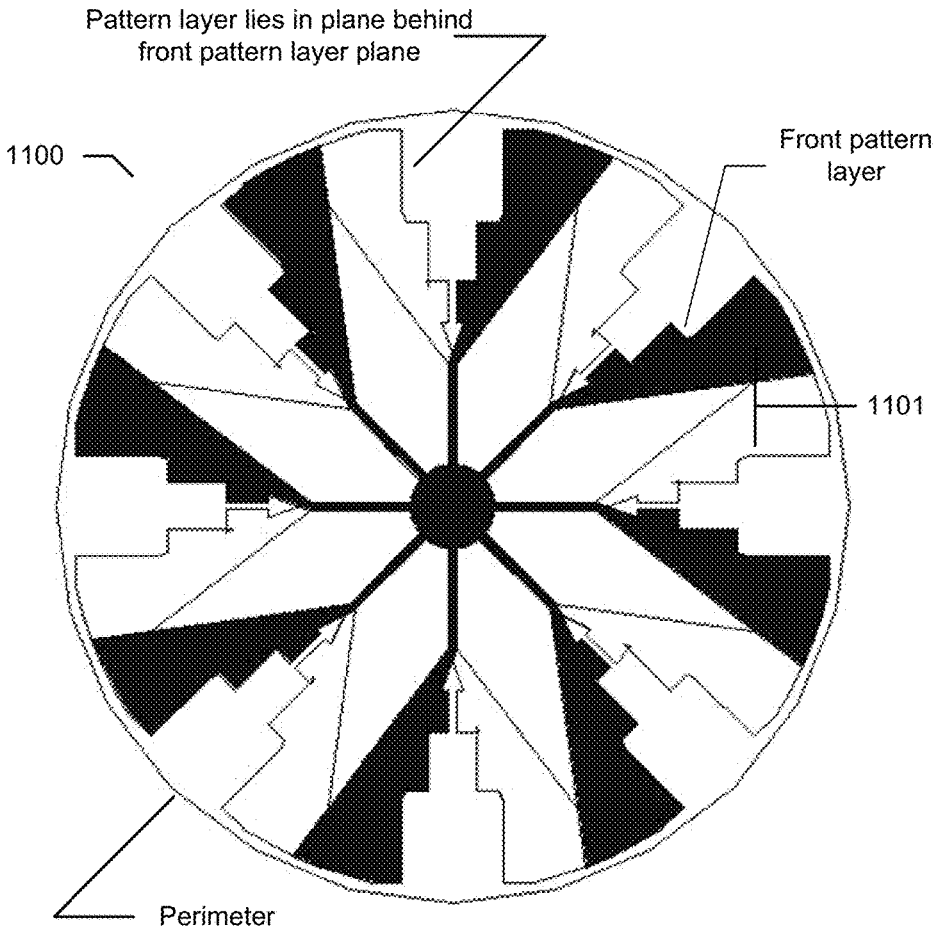
Figure 11H. Two-layer flared aperture horizontal polarization omni-directional antenna. Step flare.

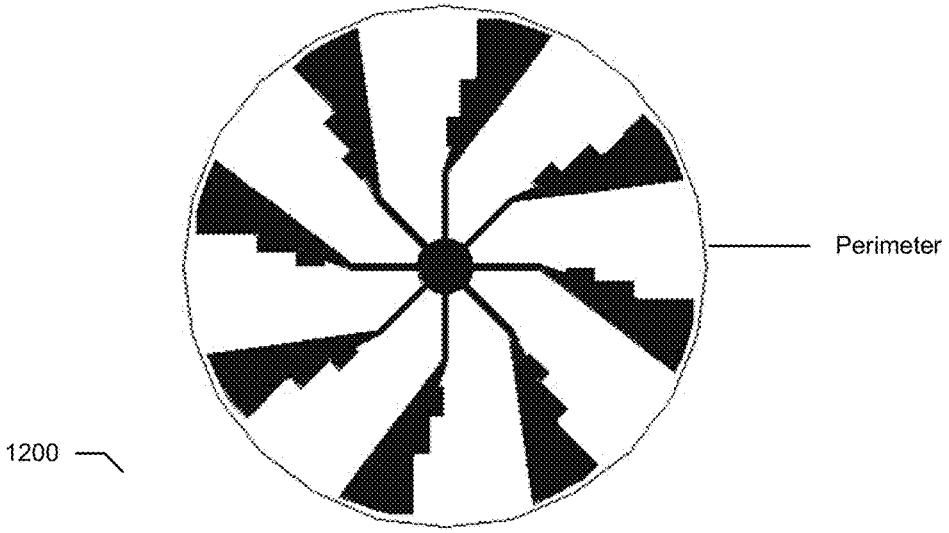
A. Electrically conductive pattern. Layer 1
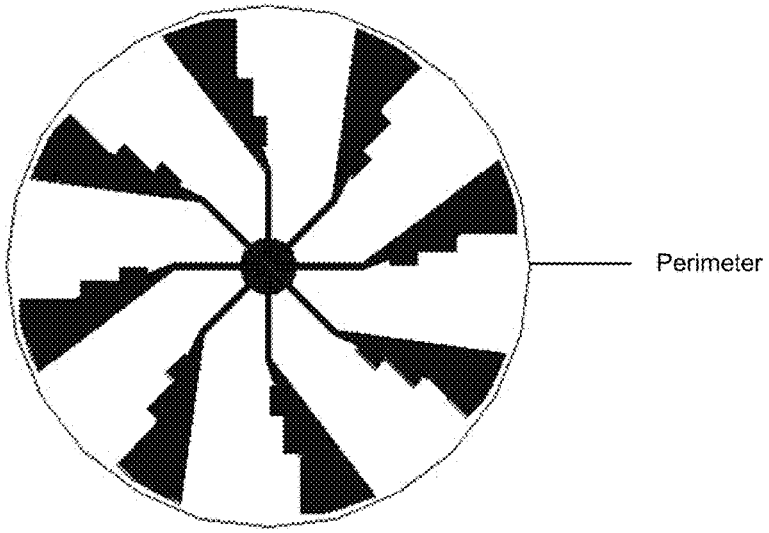
B. Electrically conductive pattern. Layer 2
Figure 12H. Two-layer Horizontal Polarization flared aperture omni-directional antenna. Step flare.

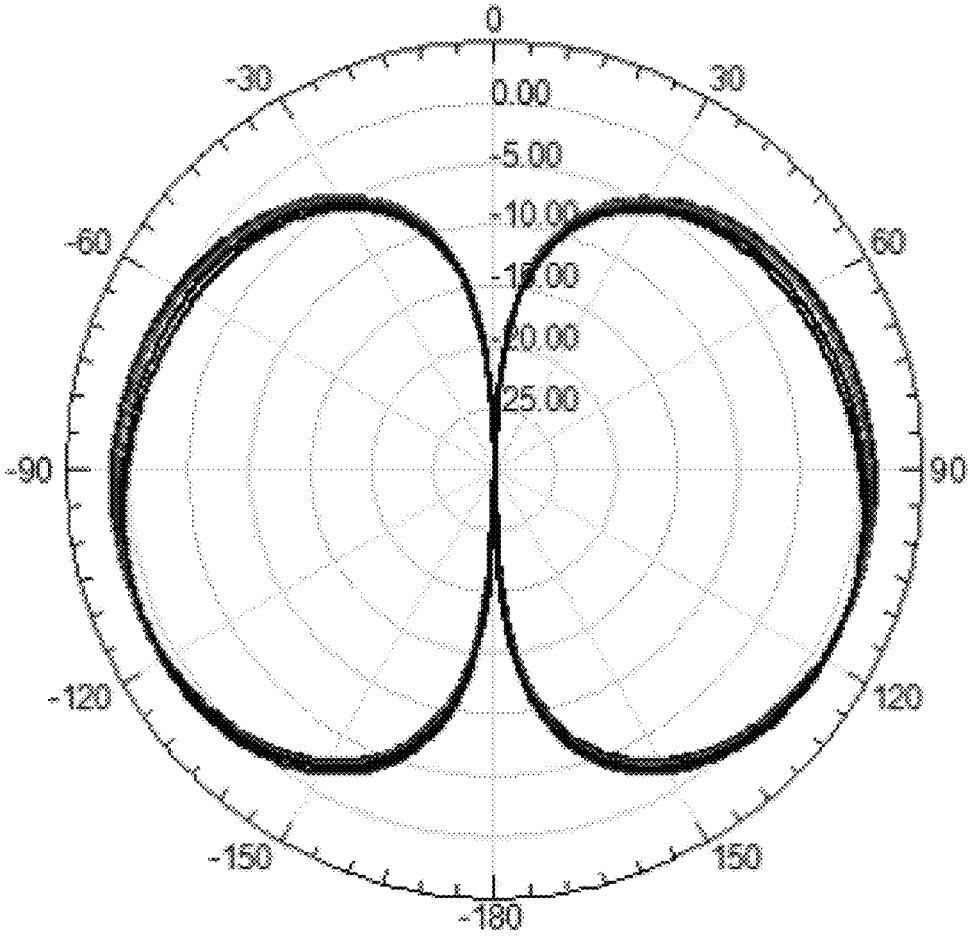
Figure 13H. Band 1-2 Elevation Pattern – conical reflector

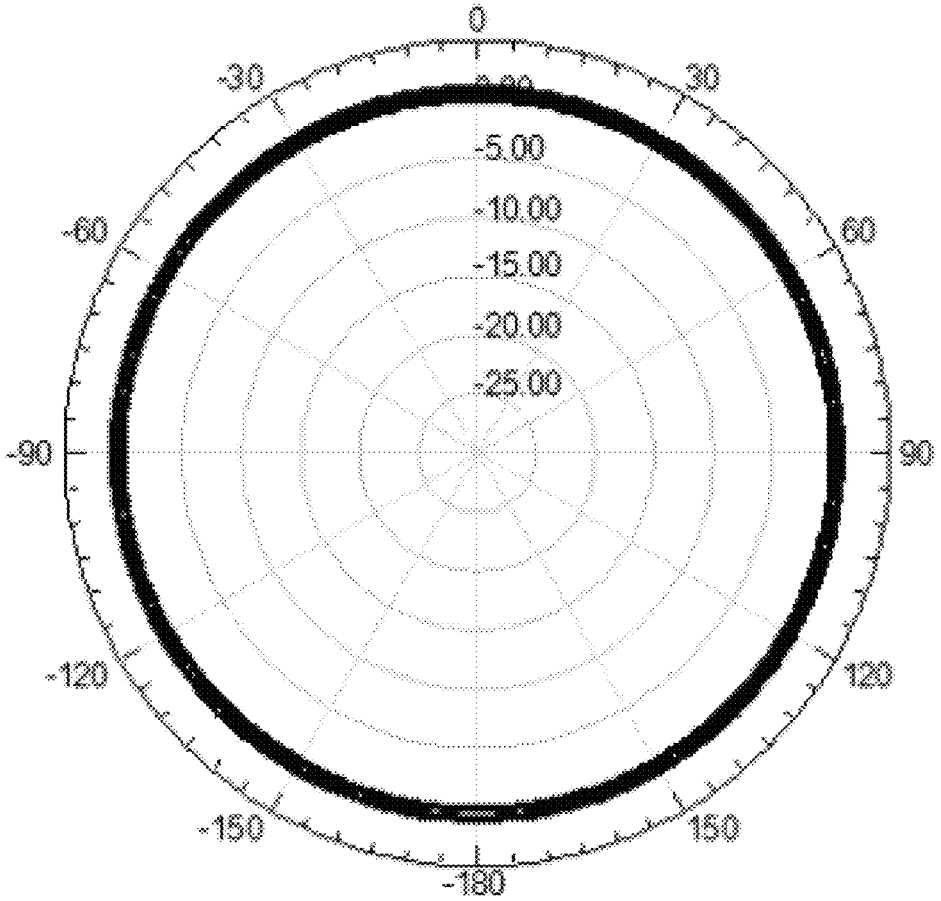
Figure 14H. Band 1-2 azimuth pattern – conical reflector

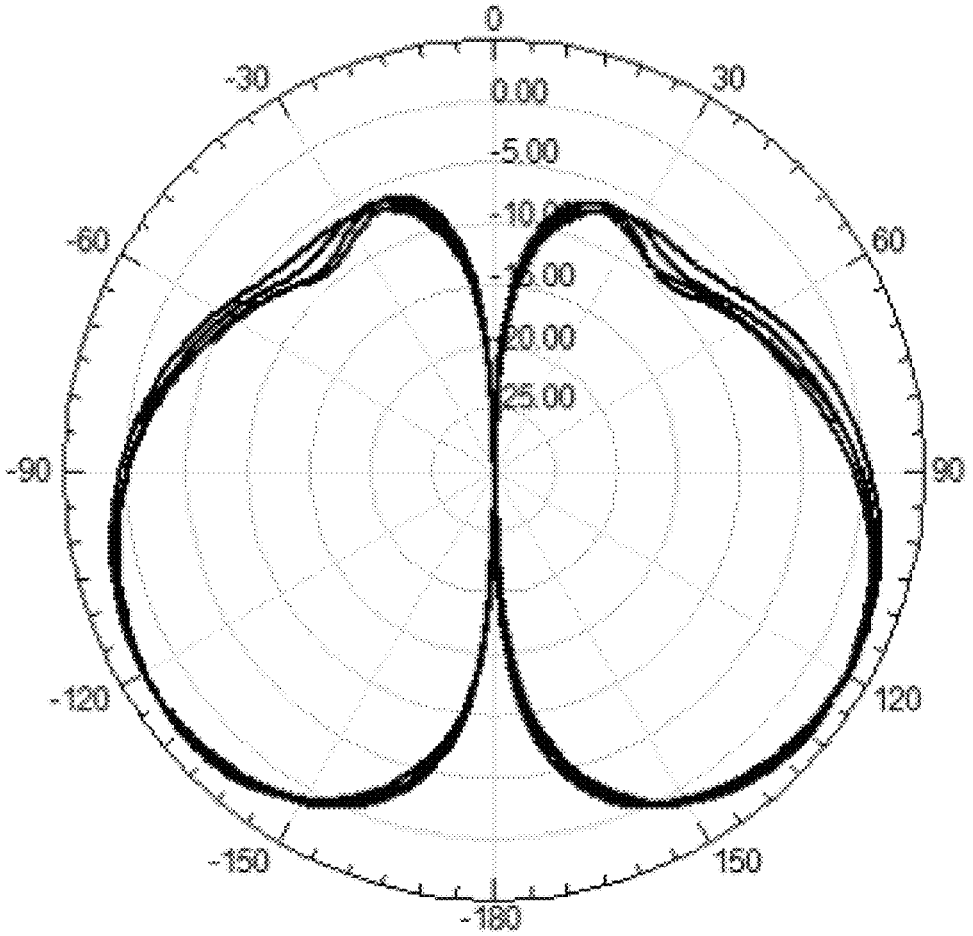
Figure 15H. Band 3 elevation pattern – conical reflector

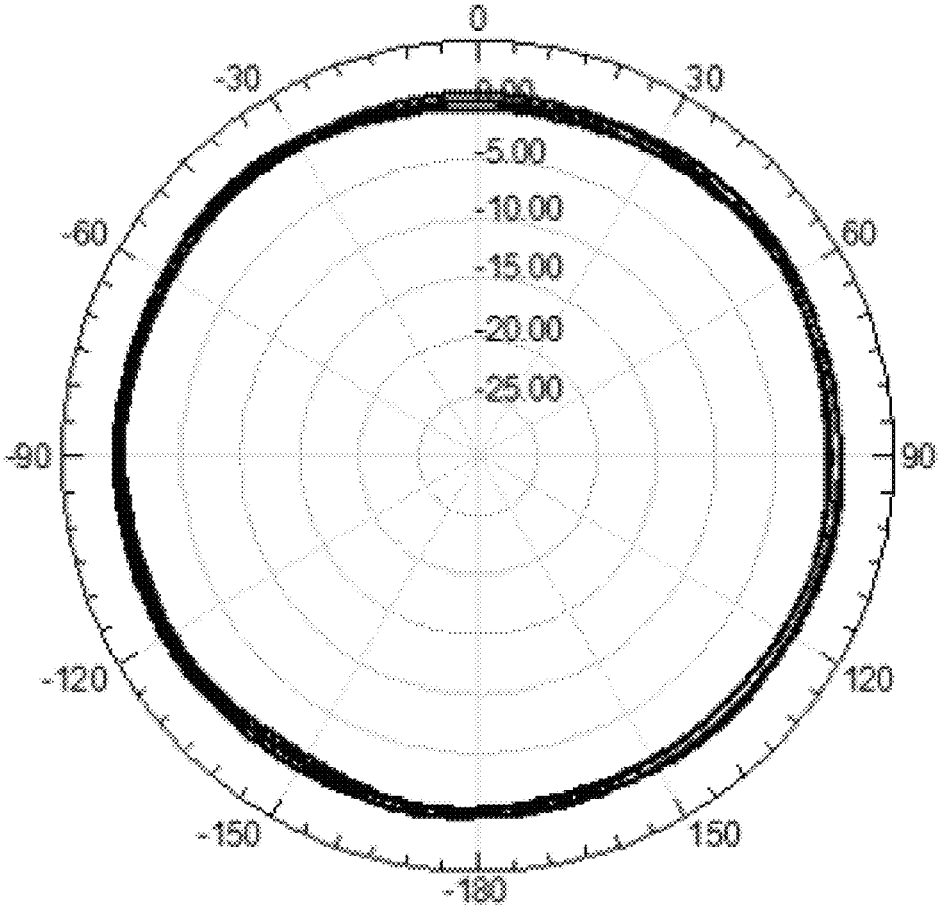
Figure 16H. Band 3 azimuth pattern – conical reflector

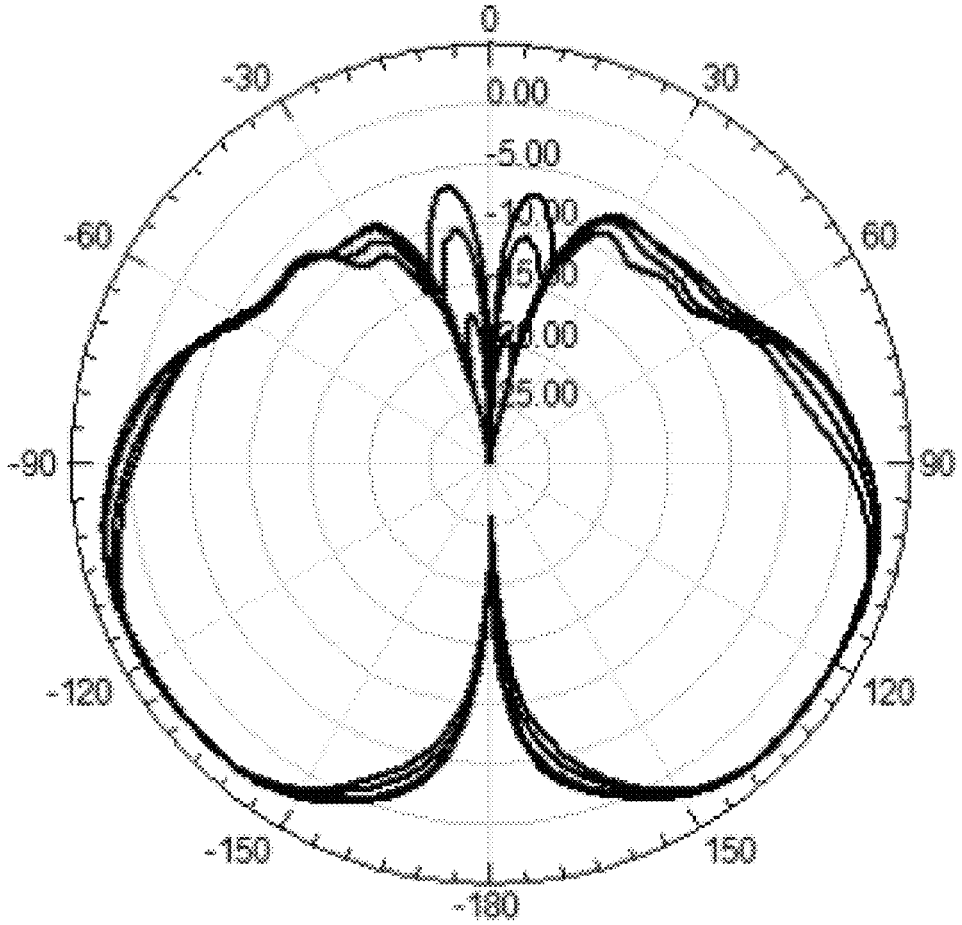
Figure 17H. Band 4 elevation pattern – conical reflector

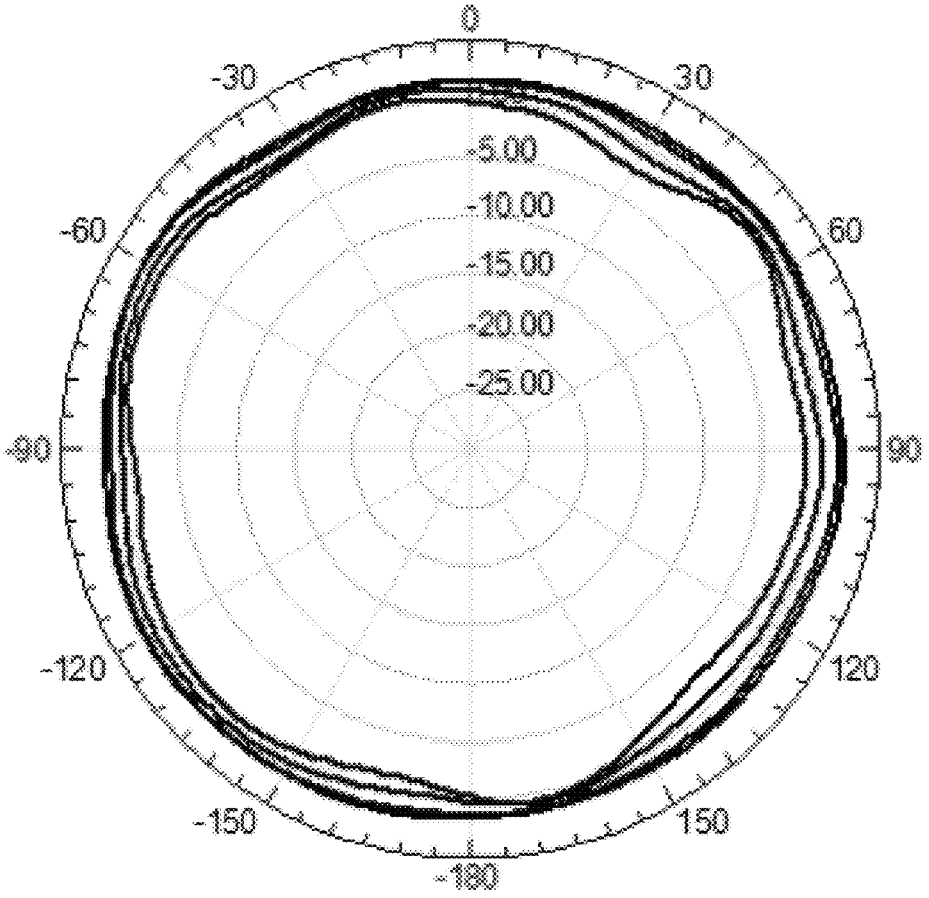
Figure 18H. Band 4 azimuth pattern – conical reflector

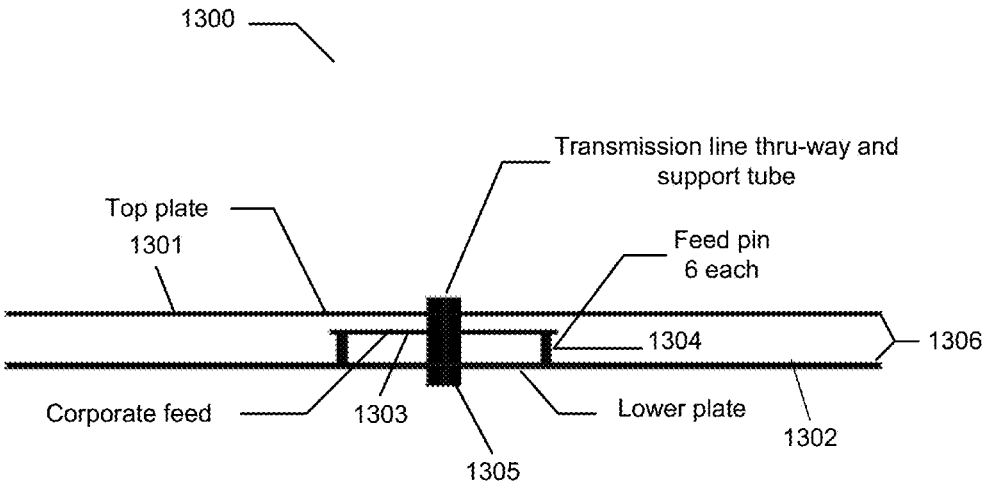
Figure 1V. Assembly side view of a six feed vertical polarization parallel plate antenna

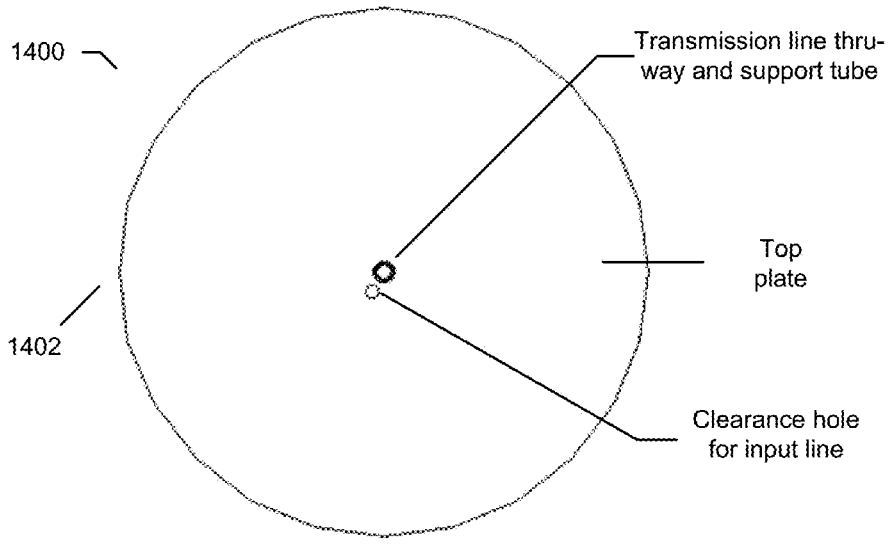
A. Top plate
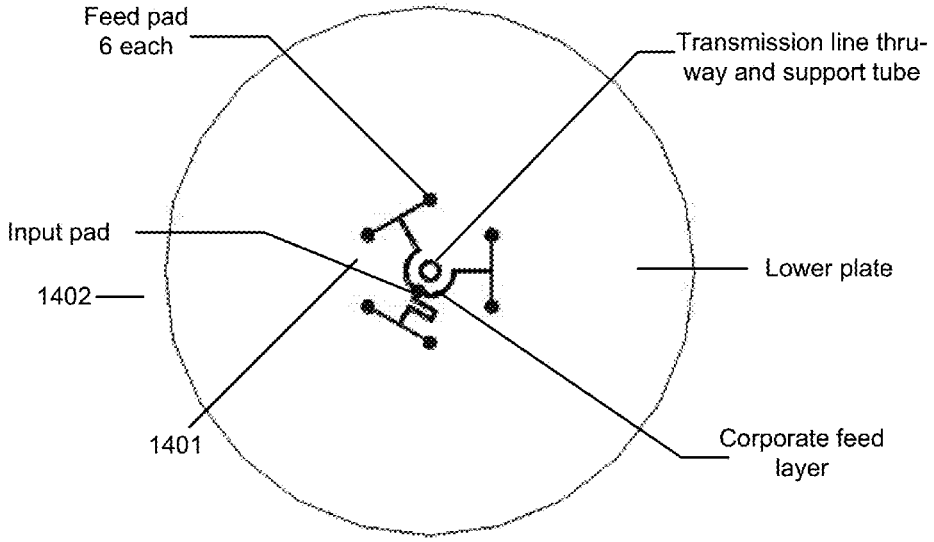
B. Lower plate and corporate feed
Figure 2V. Top views of the layers of a six feed vertical polarization parallel plate antenna

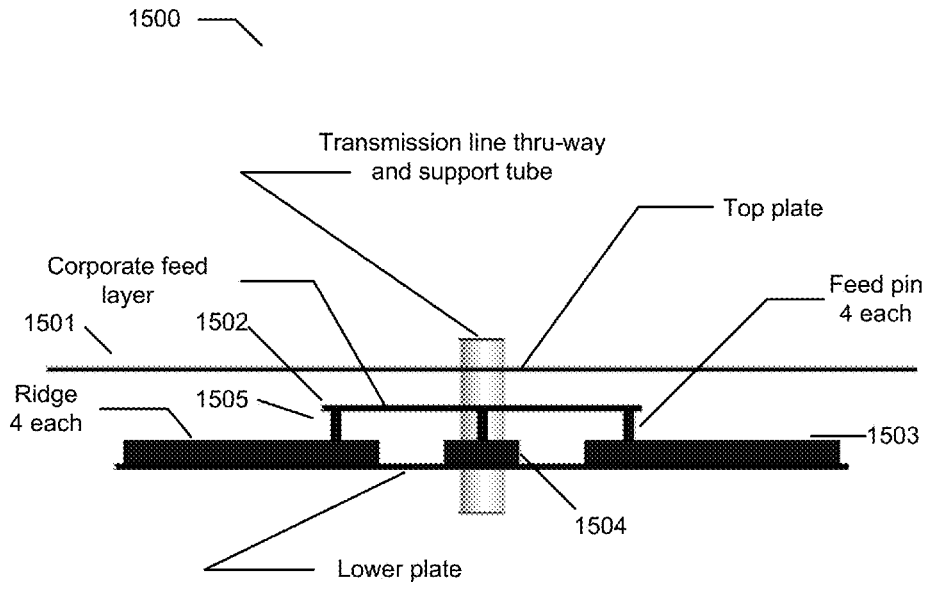
Figure 3V. Assembly side view of a four ridge vertical polarization parallel plate antenna

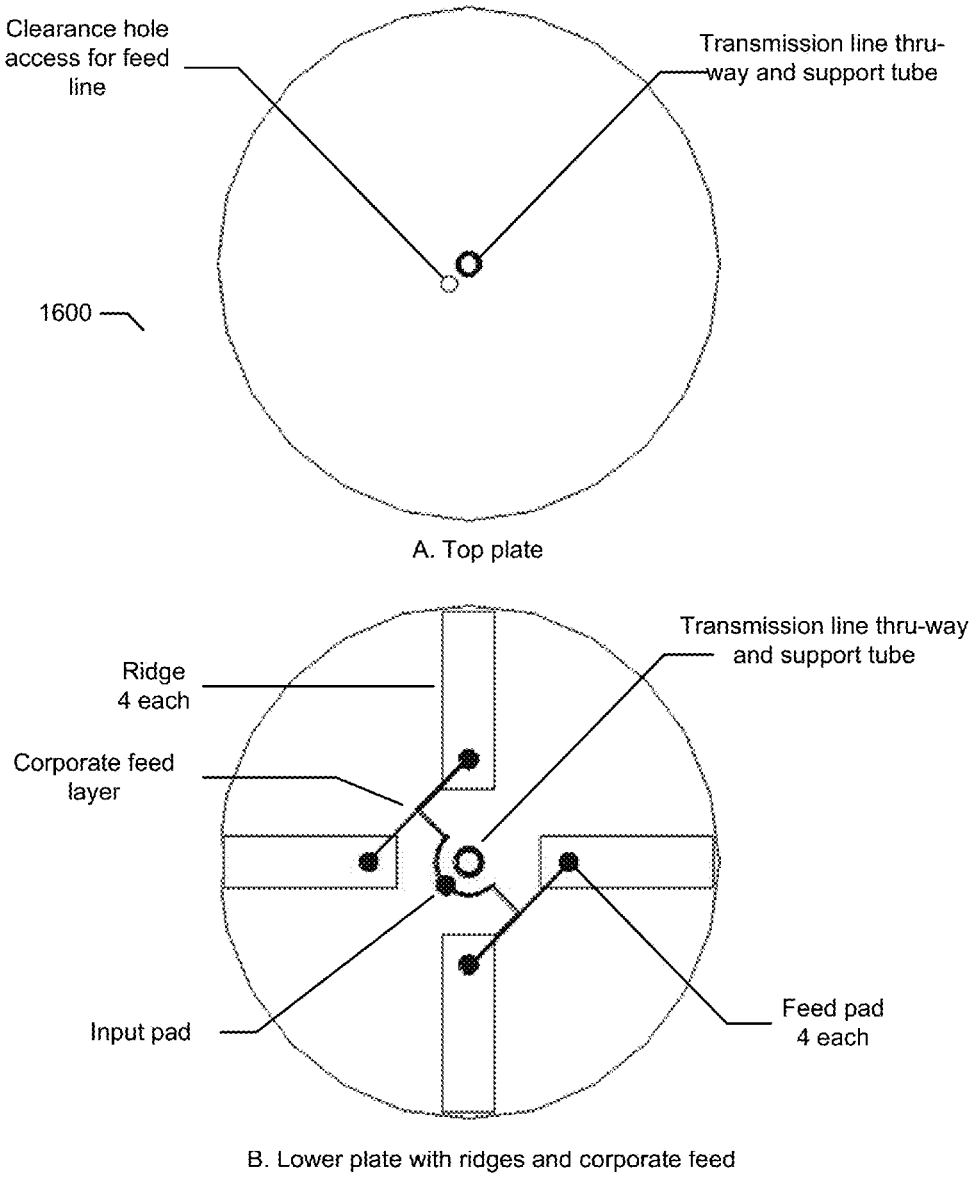
Figure 4V. Top view of the layers of a four ridge vertical polarization parallel plate antenna

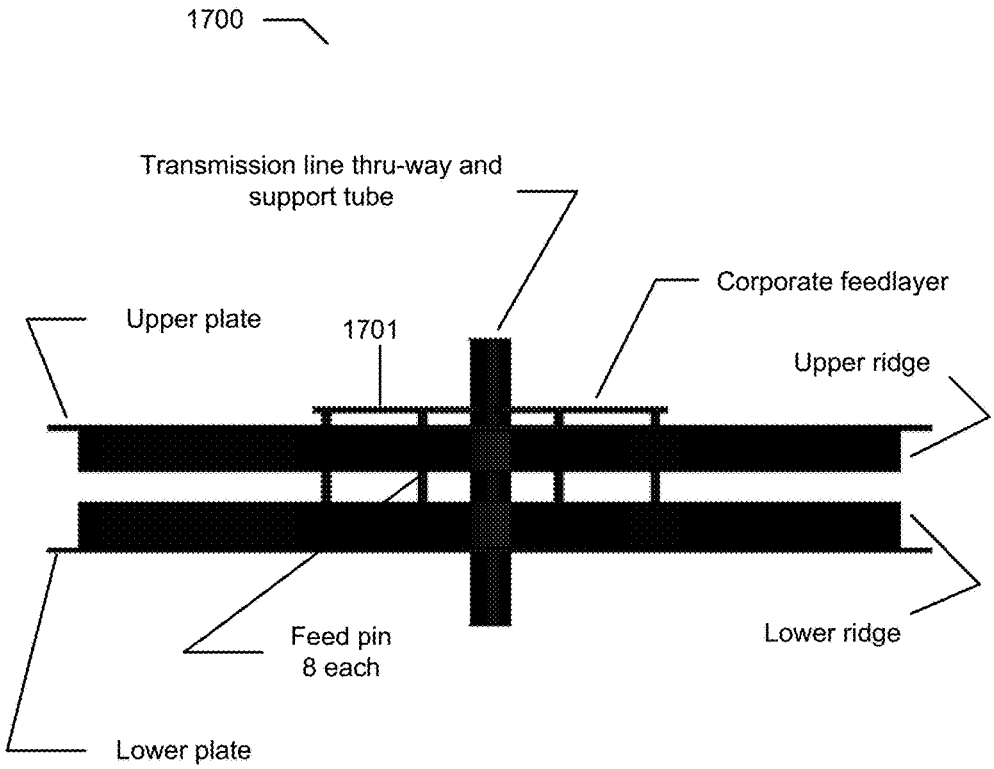
Figure 5V. Assembly side view of an eight double ridge vertical polarization parallel plate antenna

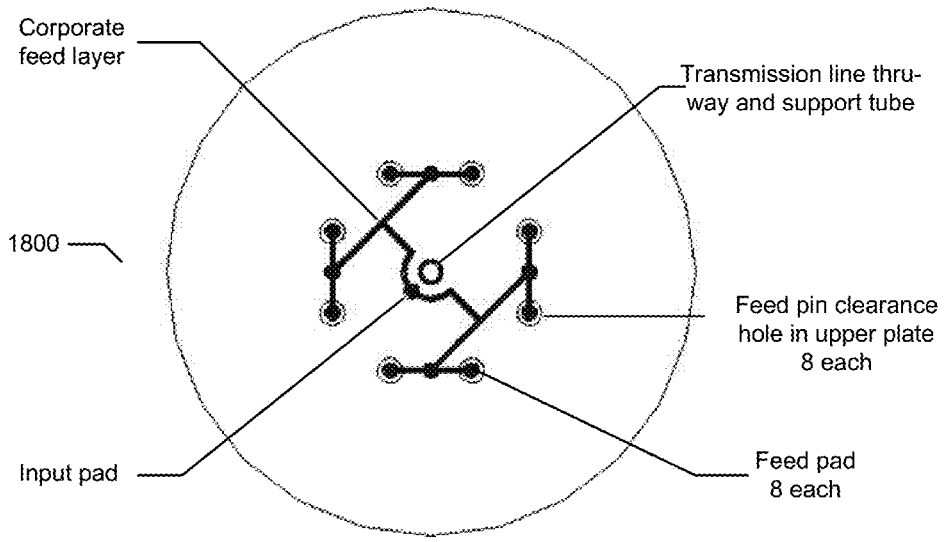
A. Upper plate with corporate feed layer superimposed
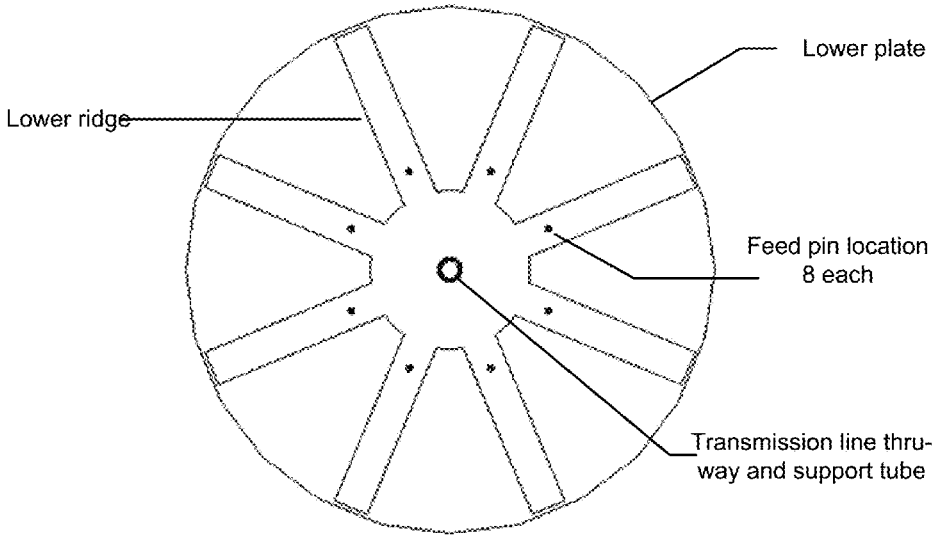
B. Lower plate with lower ridge
Figure 6V. Top view of the layers of an eight double ridge vertical polarization parallel plate antenna

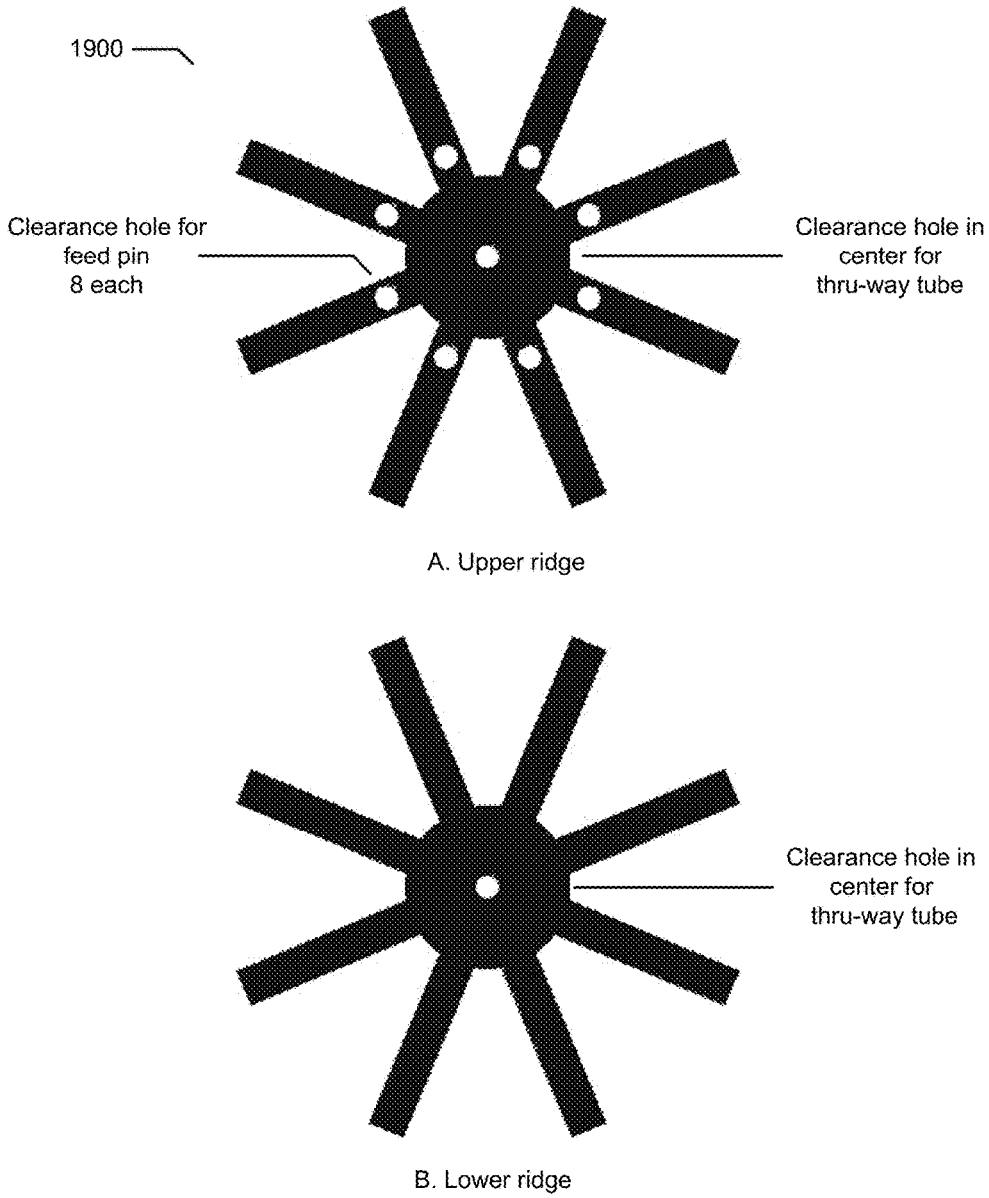
Figure 7V. Upper and lower ridge configurations for an eight double ridge design

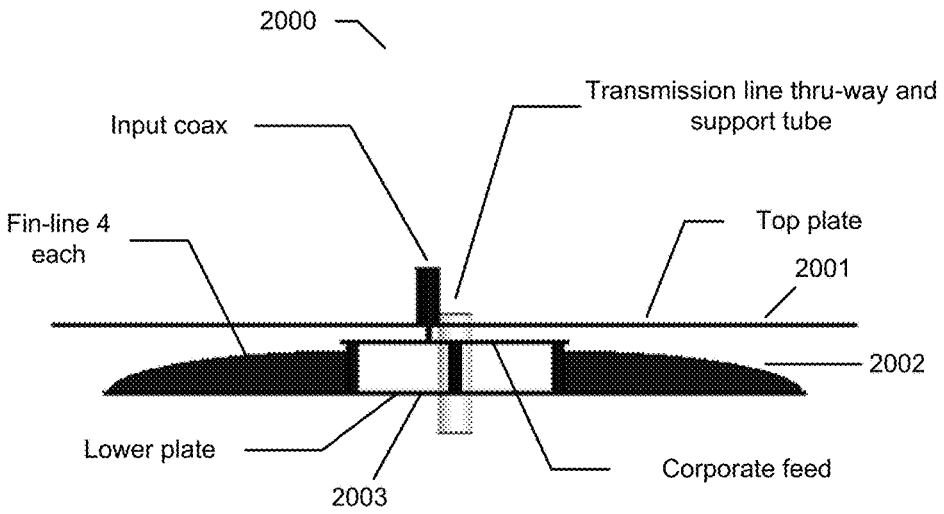
Figure 8V. Assembly side view of a four fin-line vertical polarization parallel plate antenna

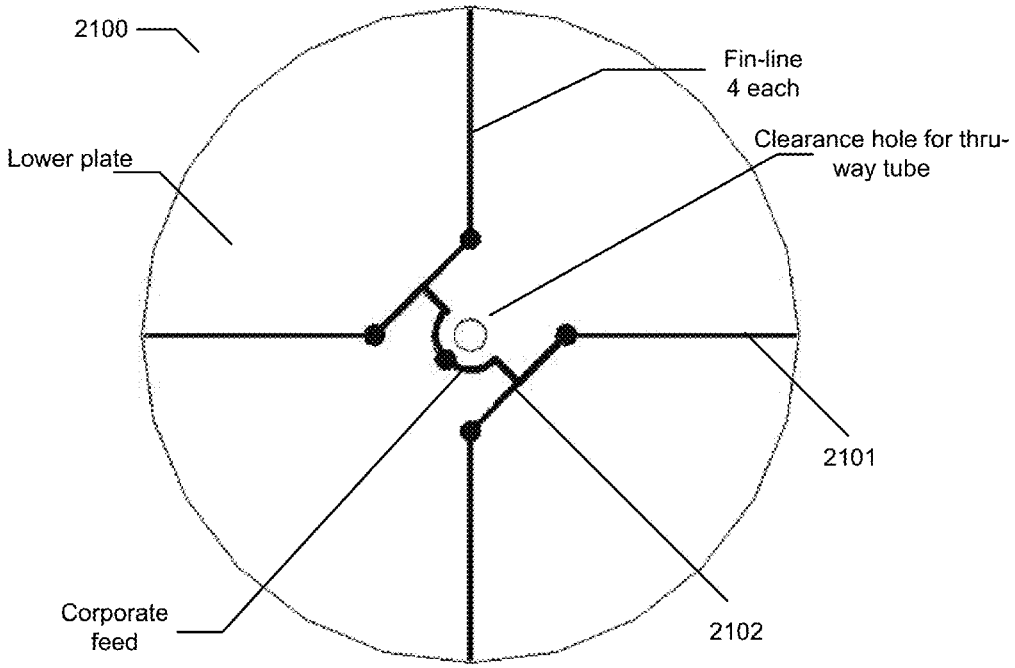
A. Lower plate with corporate feed layer and fin-lines superimposed
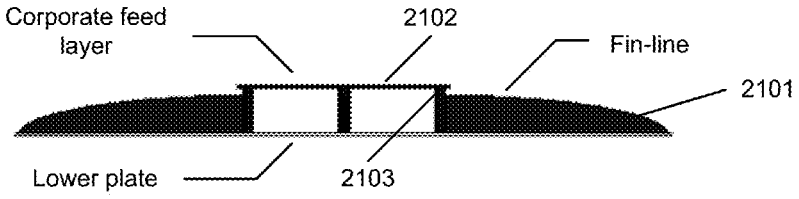
B. Side view of fin-lines
Figure 9V. Side and top views of the fin-line configuration

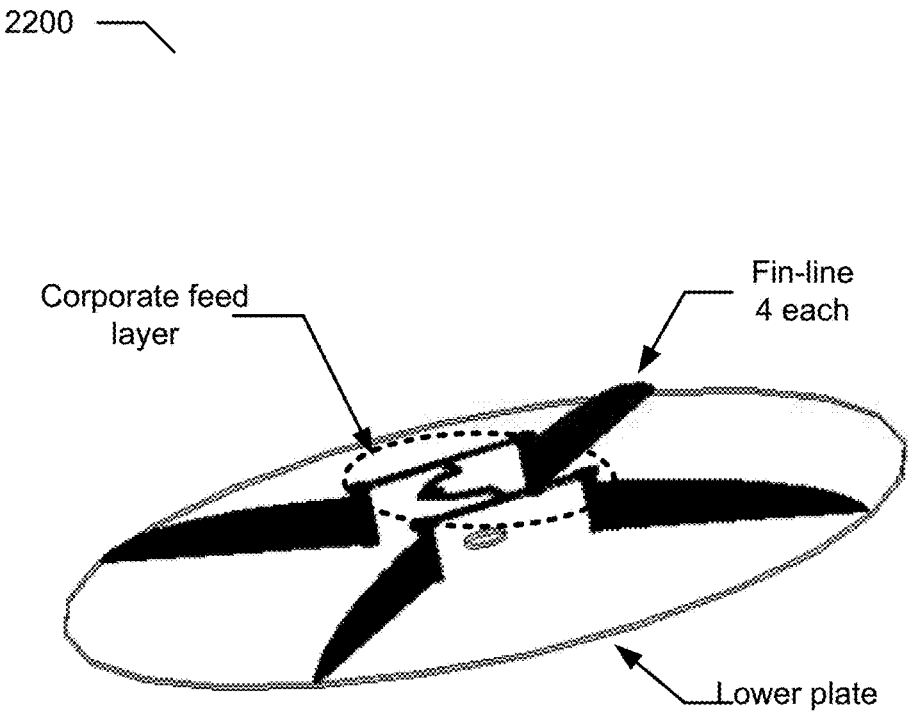
Figure 10V. Perspective view of the corporate feed and fin-line configuration

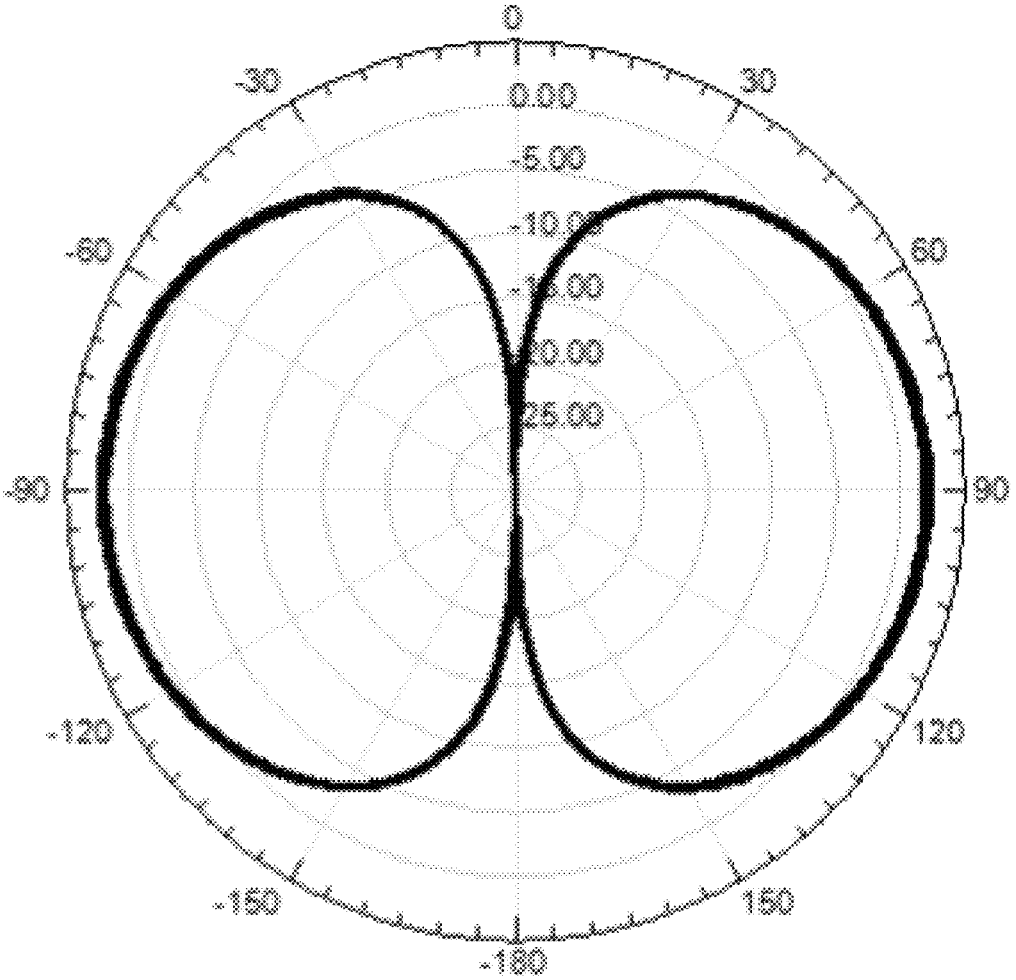
Figure 11V. Band 1-2 elevation pattern – six feeds

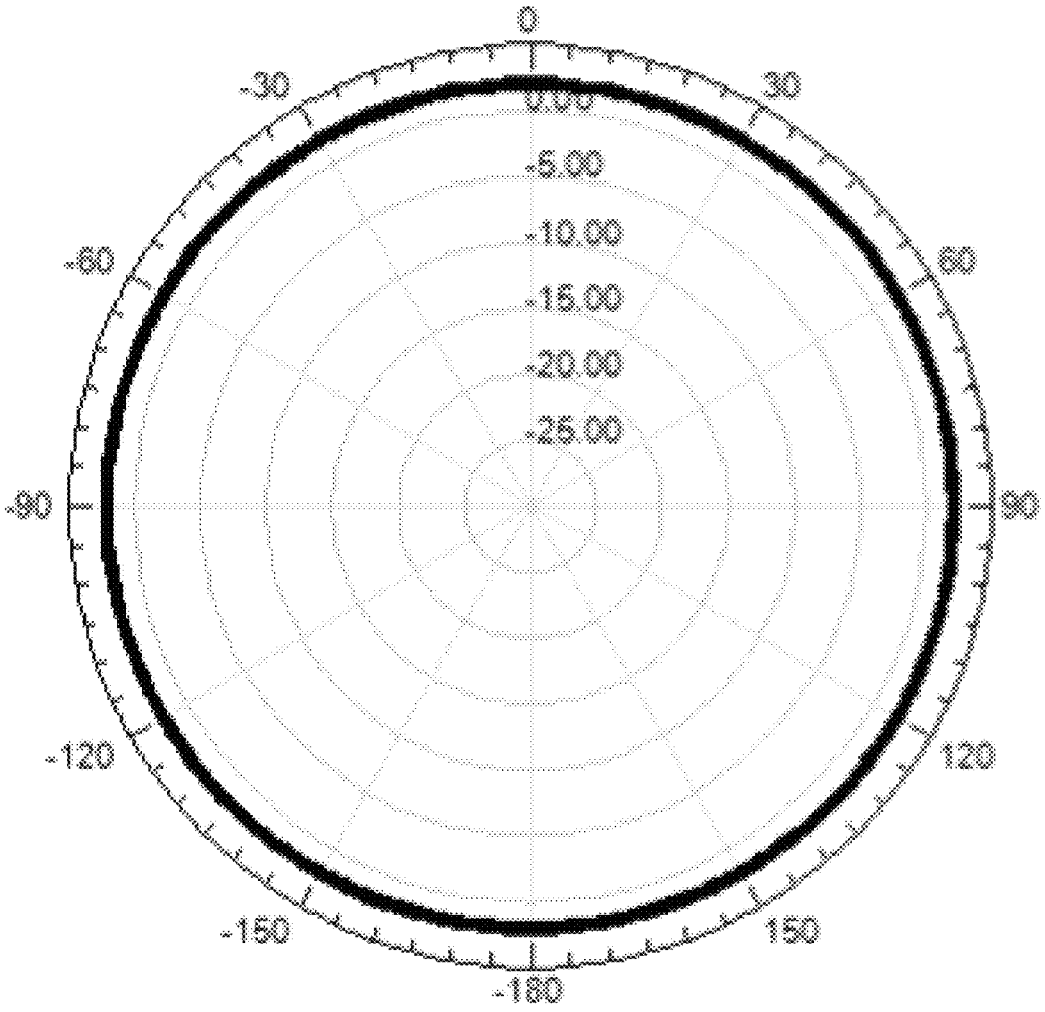
Figure 12V. Band 1-2 azimuth pattern – six feeds

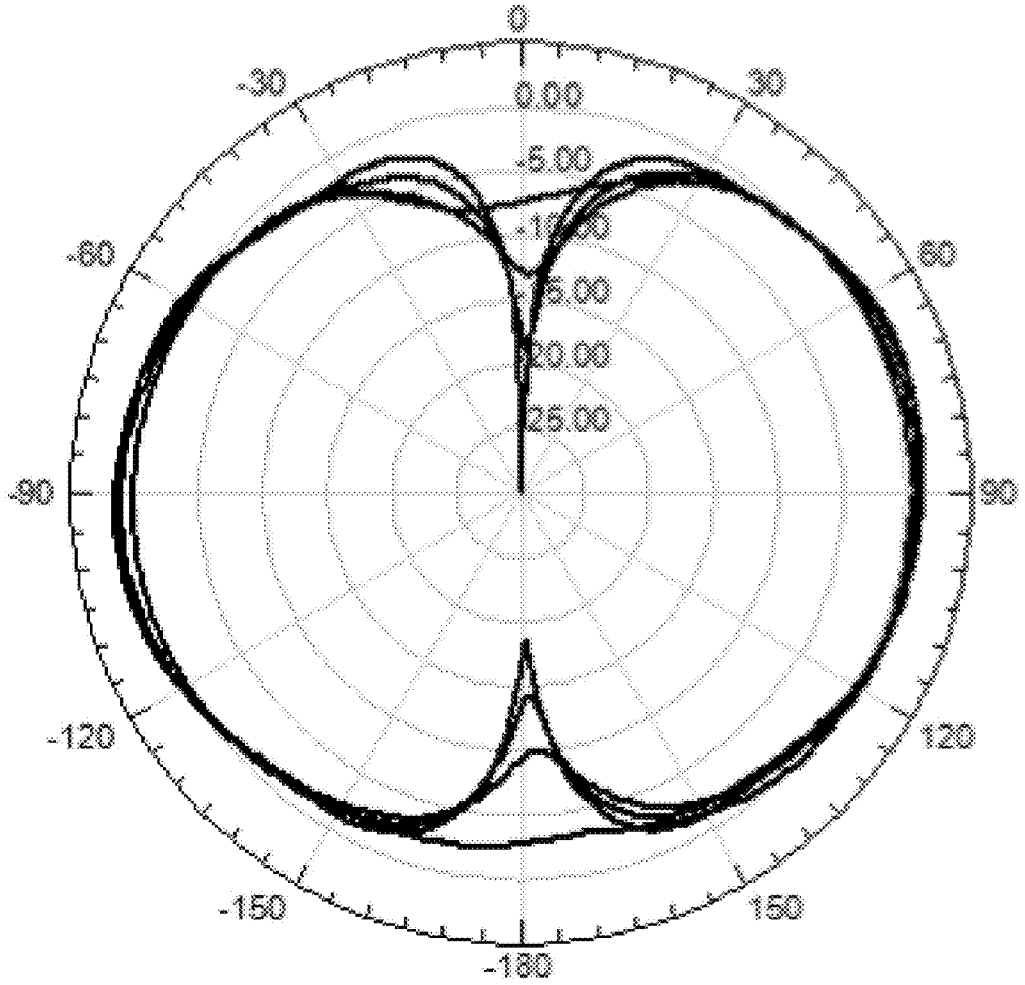
Figure 13V. Band 3 elevation pattern – six feeds

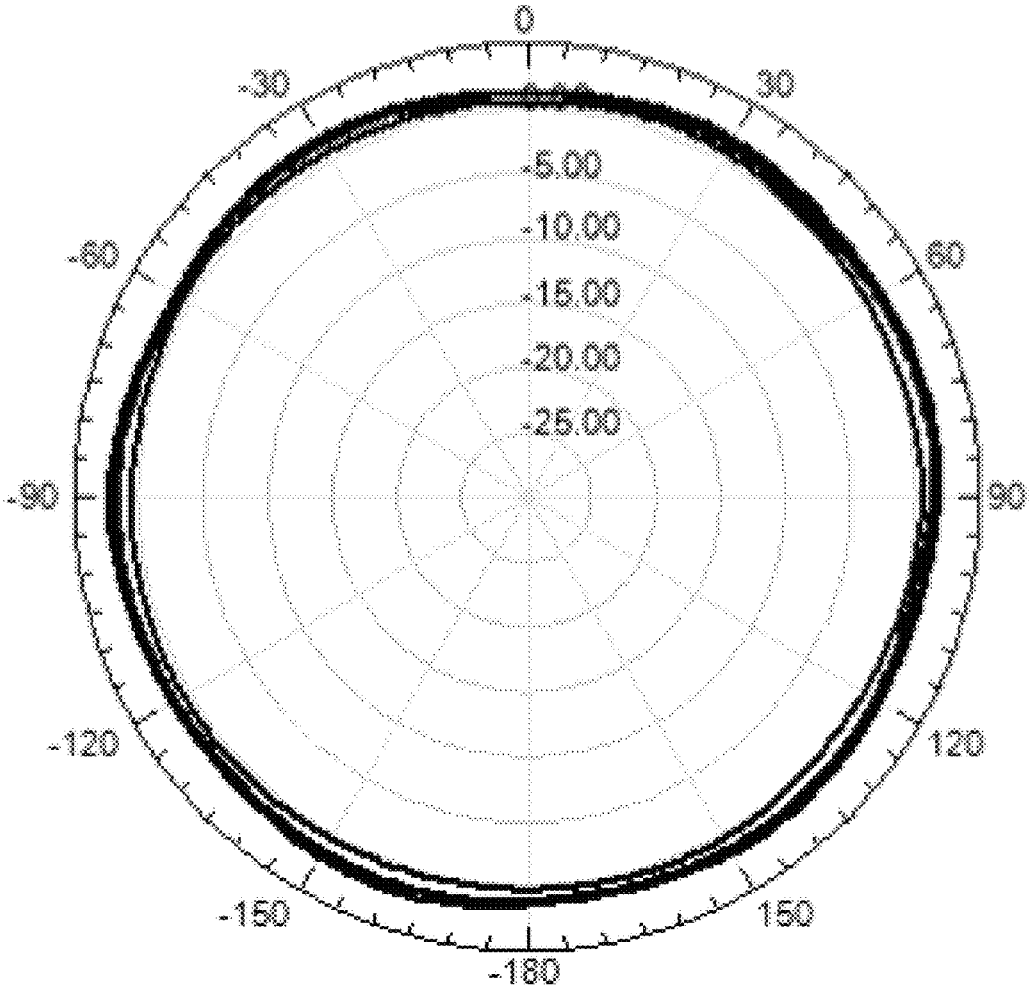
Figure 14V. Band 3 azimuth pattern – six feeds

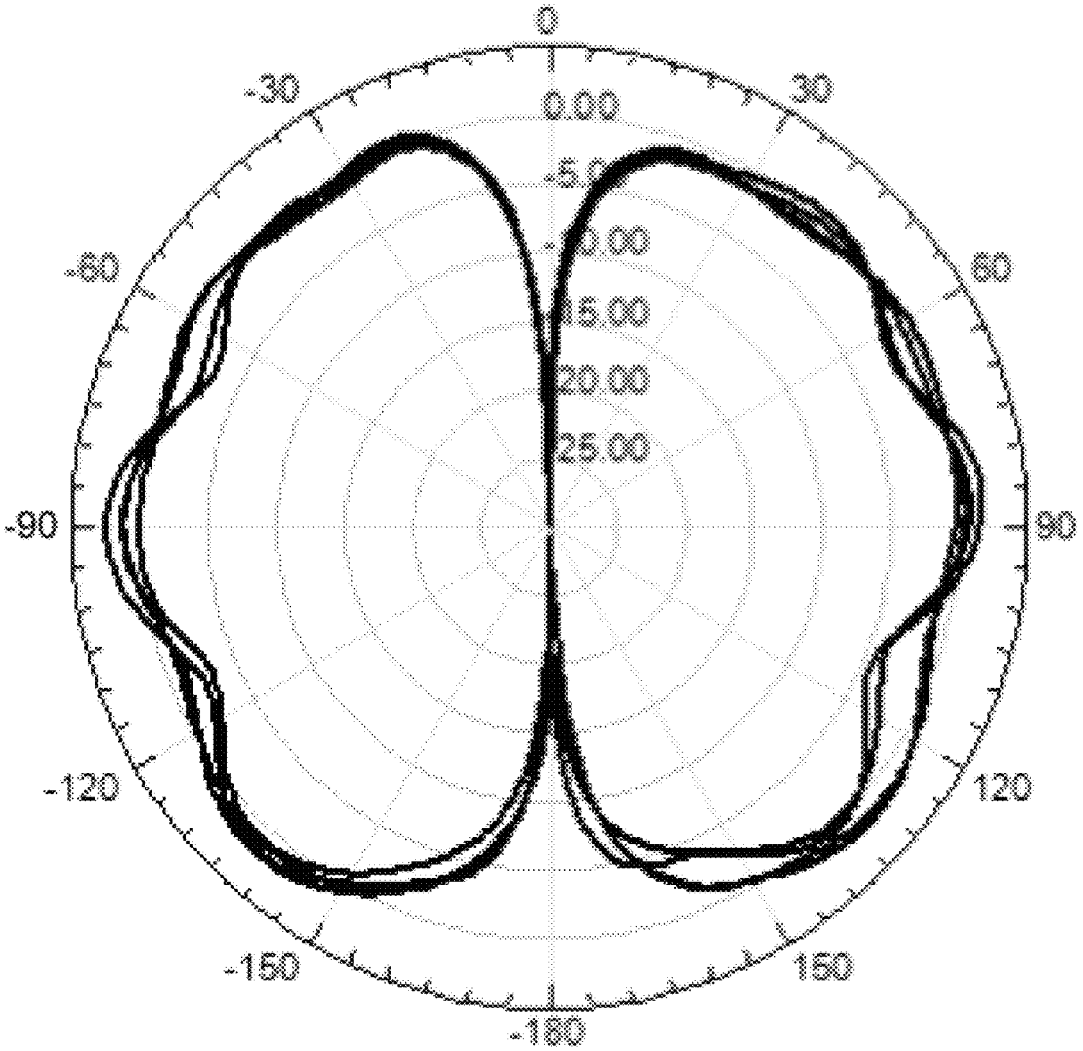
Figure 15V. Band 4 elevation pattern – six feeds

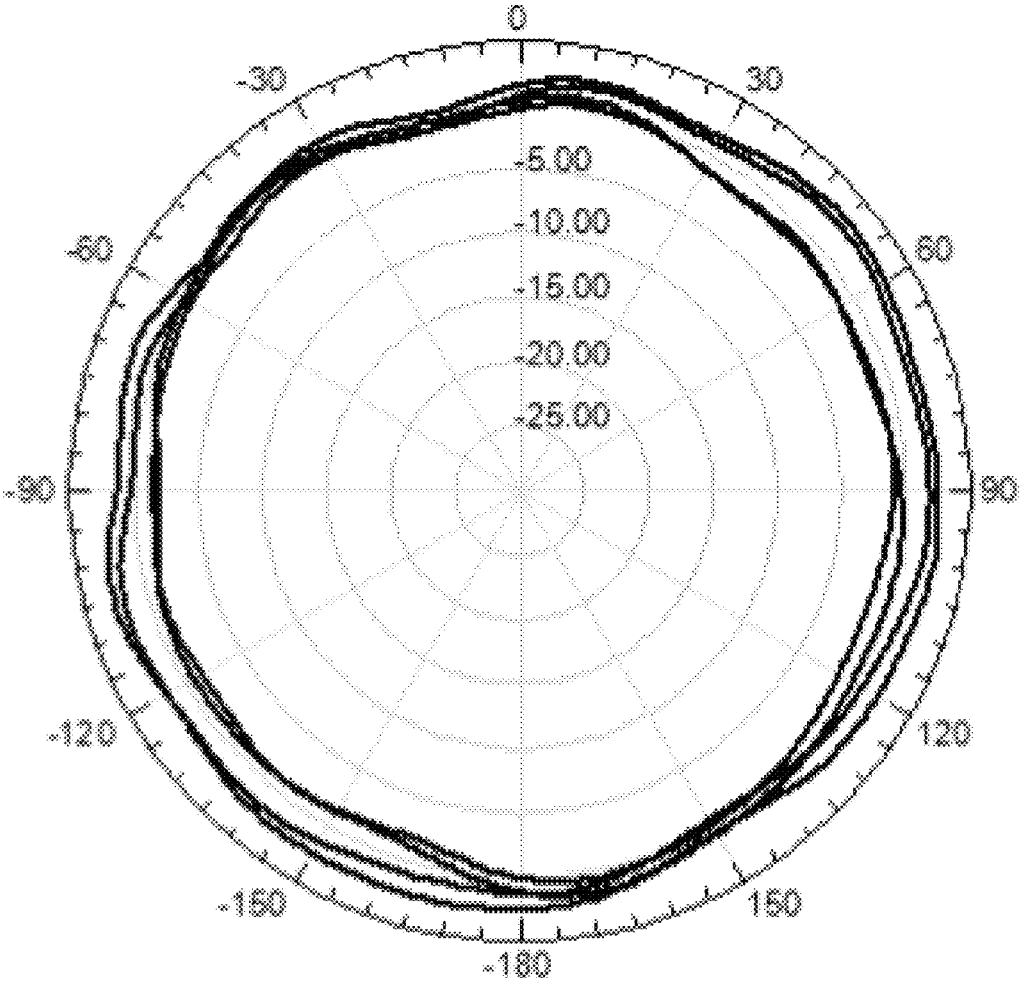
Figure 16V. Band 4 azimuth pattern – six feeds

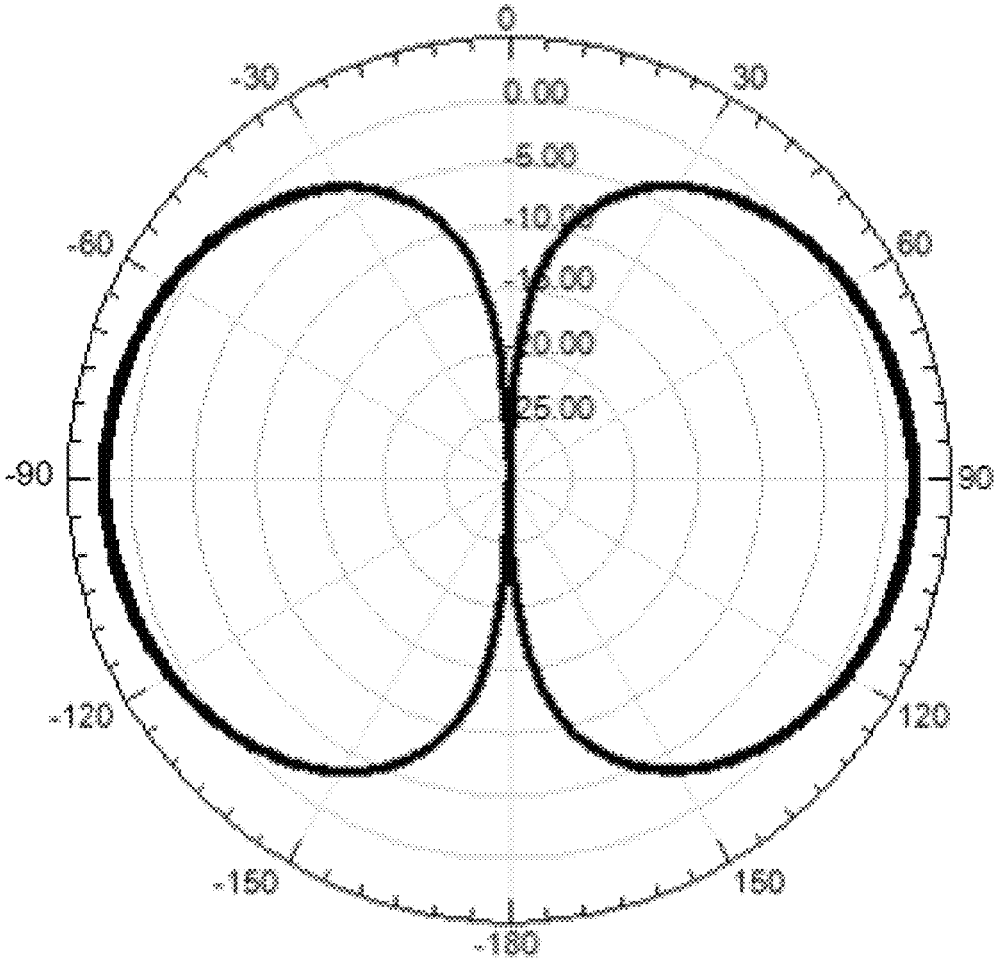
Figure 17V. Band 1-2 elevation pattern – 4 single ridges

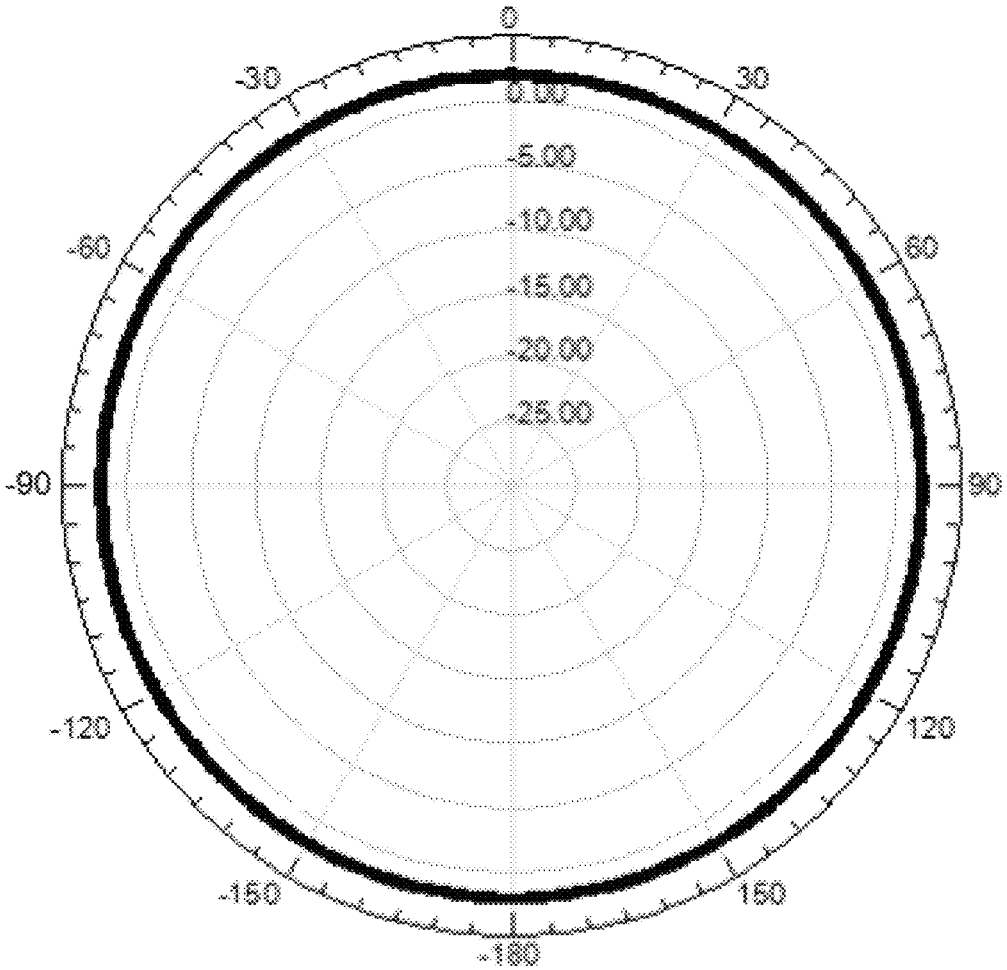
Figure 18V. Band 1-2 azimuth pattern – 4 single ridges

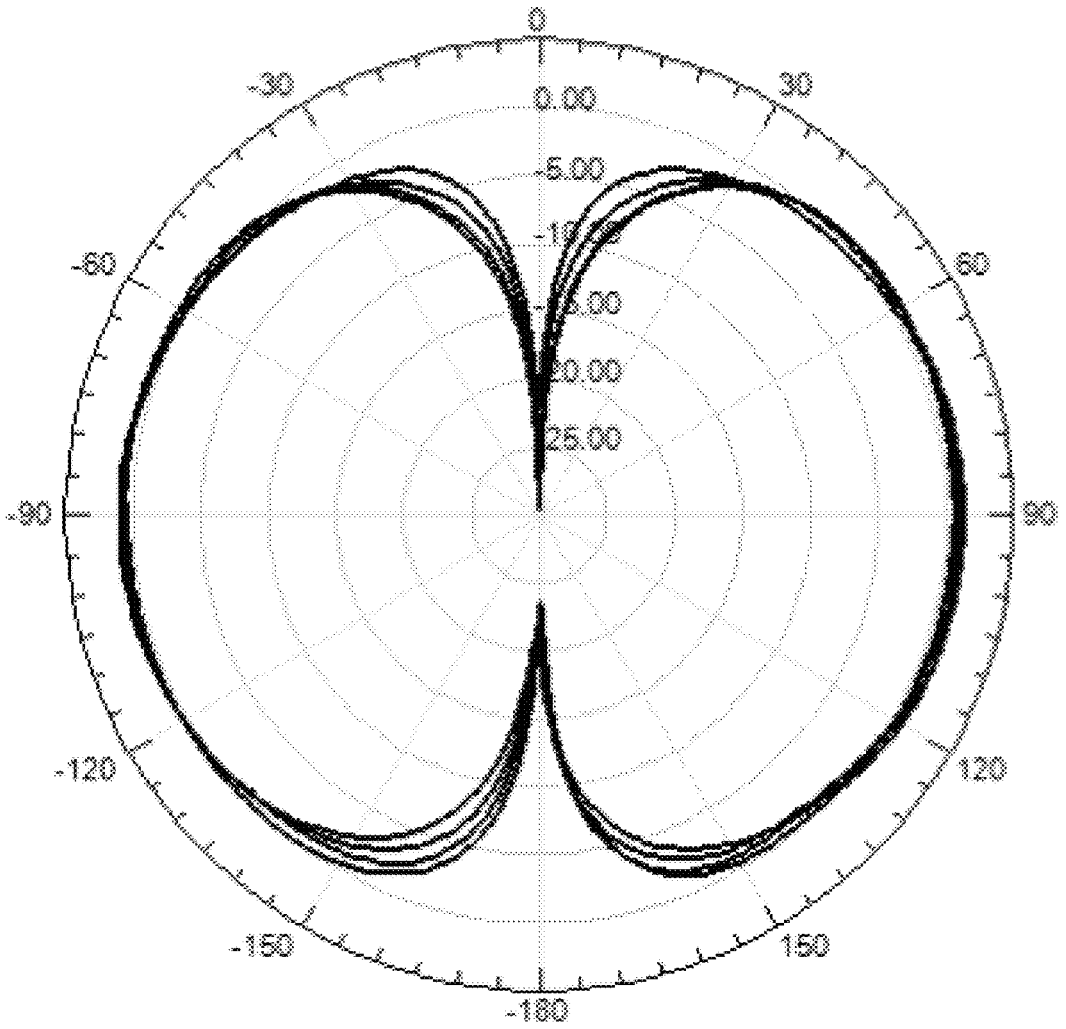
Figure 19V. Band 3 elevation pattern – 4 single ridges

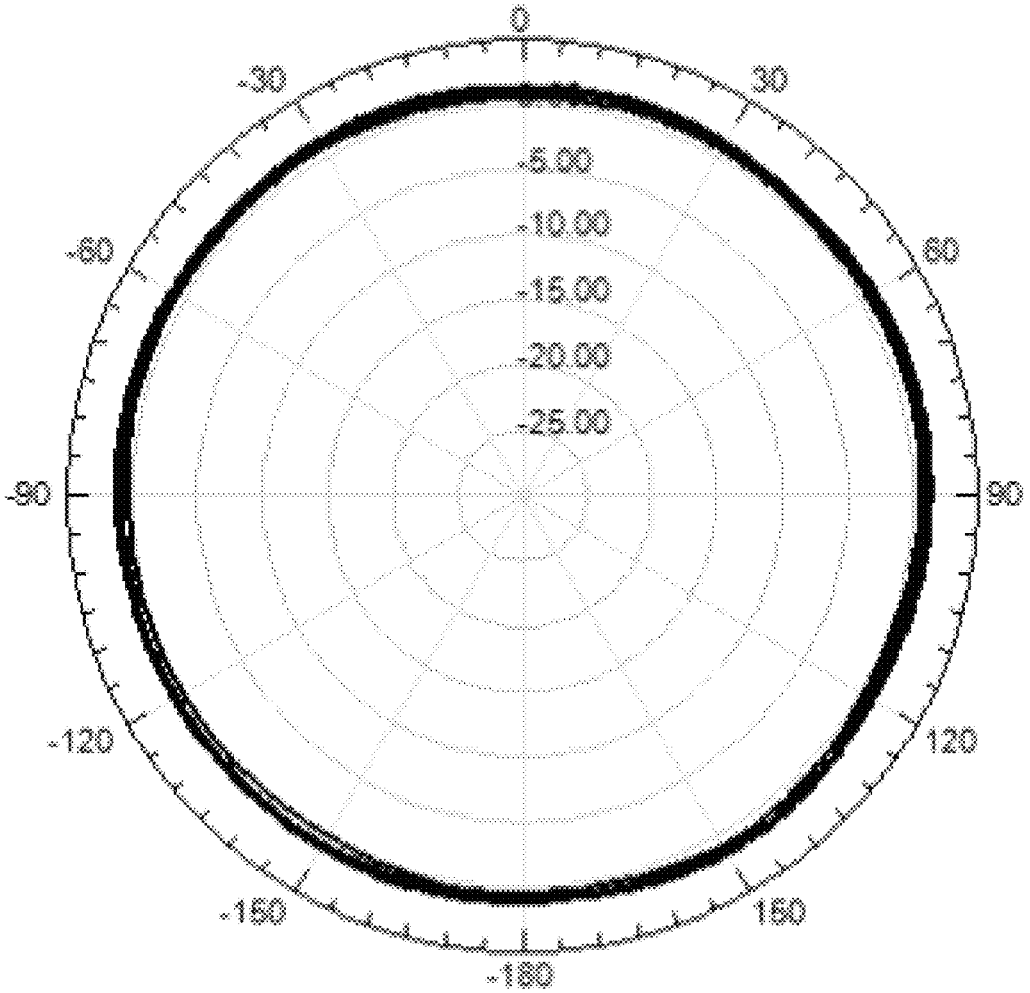
Figure 20V. Band 3 azimuth pattern – 4 single ridges

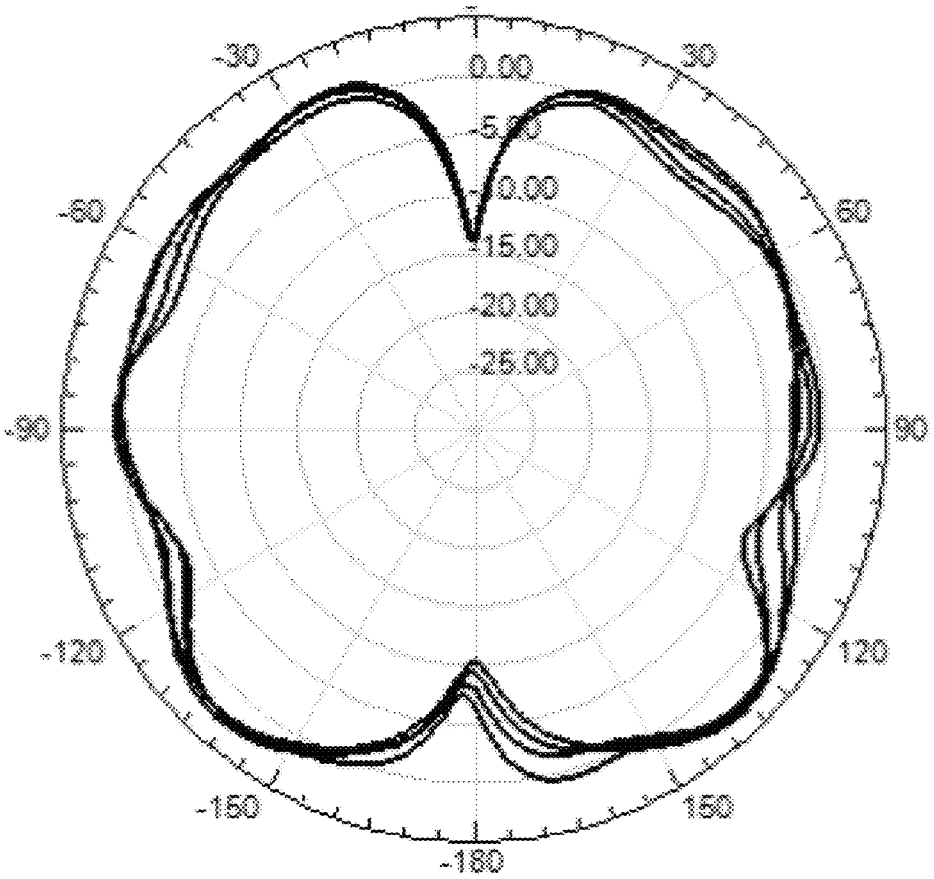
Figure 21V. Band 4 elevation pattern – 4 single ridges

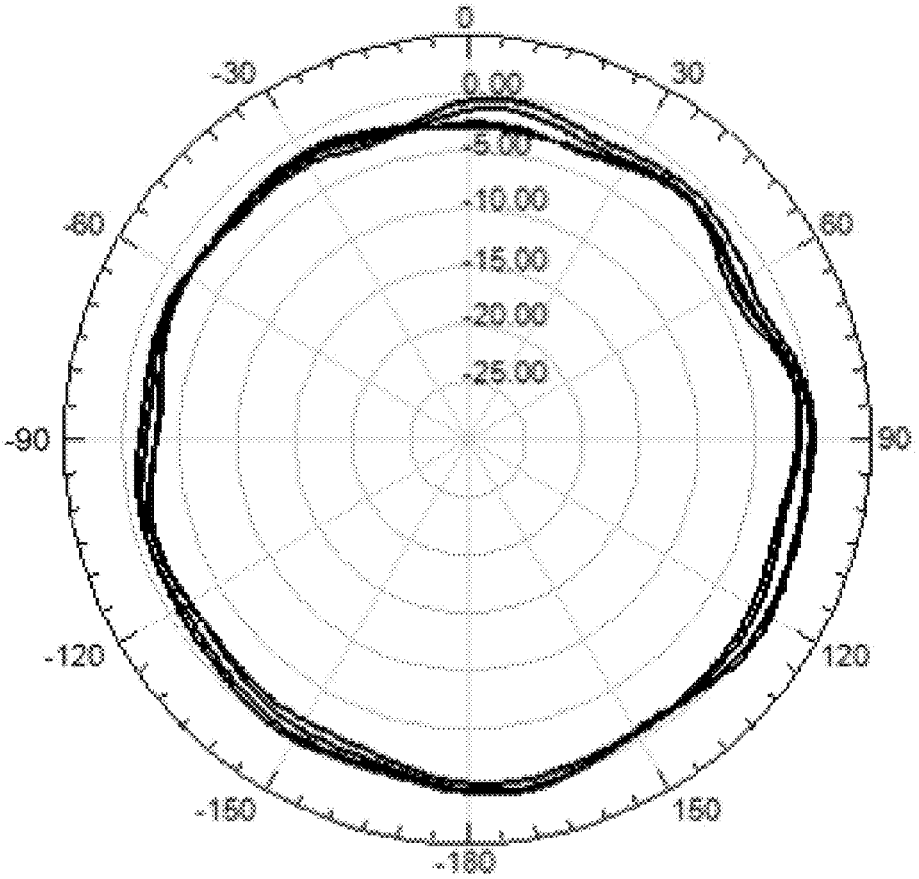
Figure 22V. Band 4 azimuth pattern – 4 single ridges

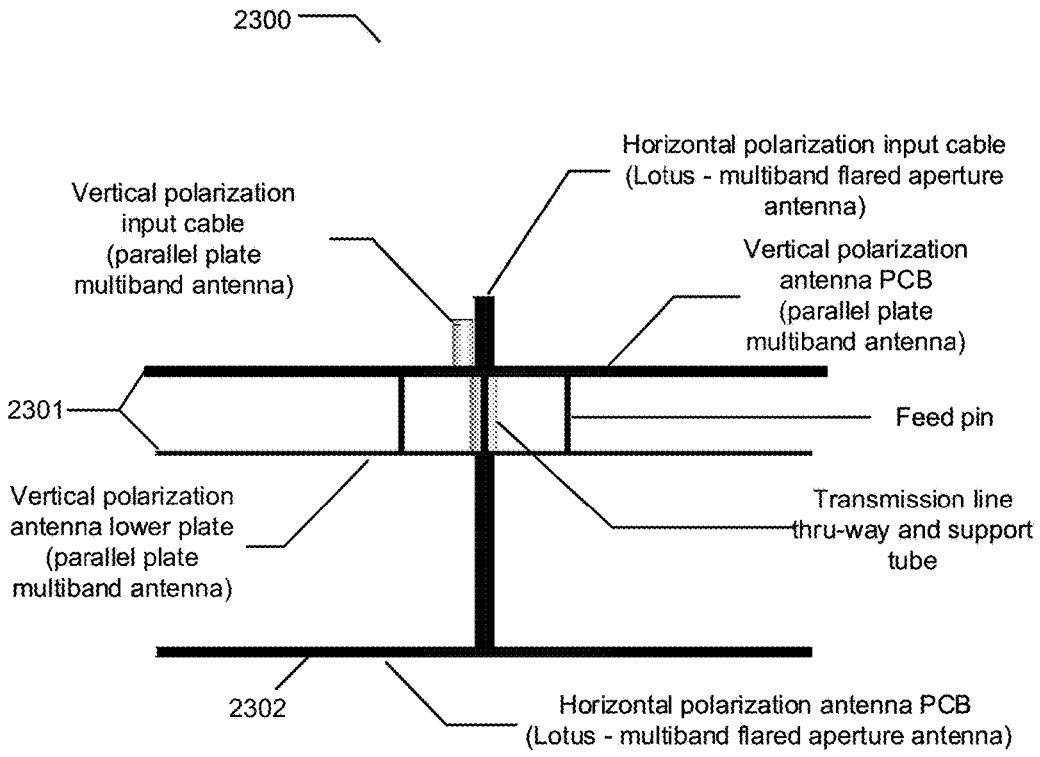
Figure 1DP. Example of a multiband dual polarization omni-directional antenna assembly

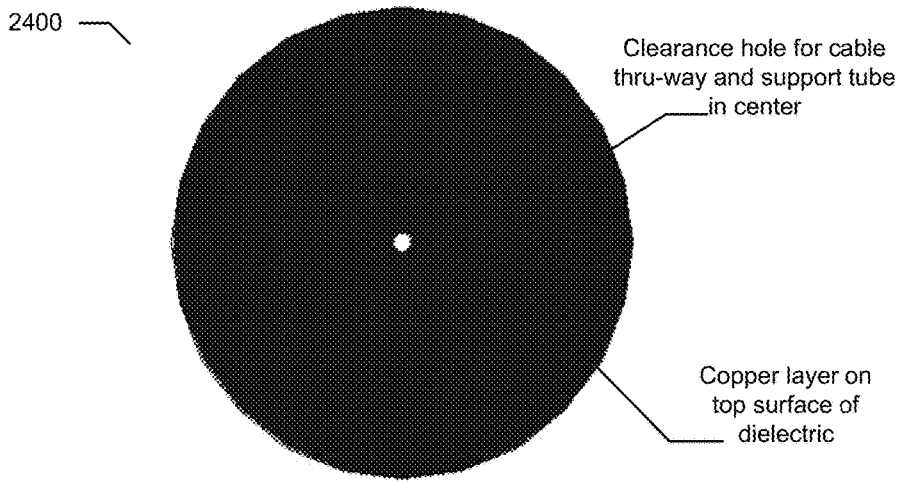
A. Ground layer of laminate
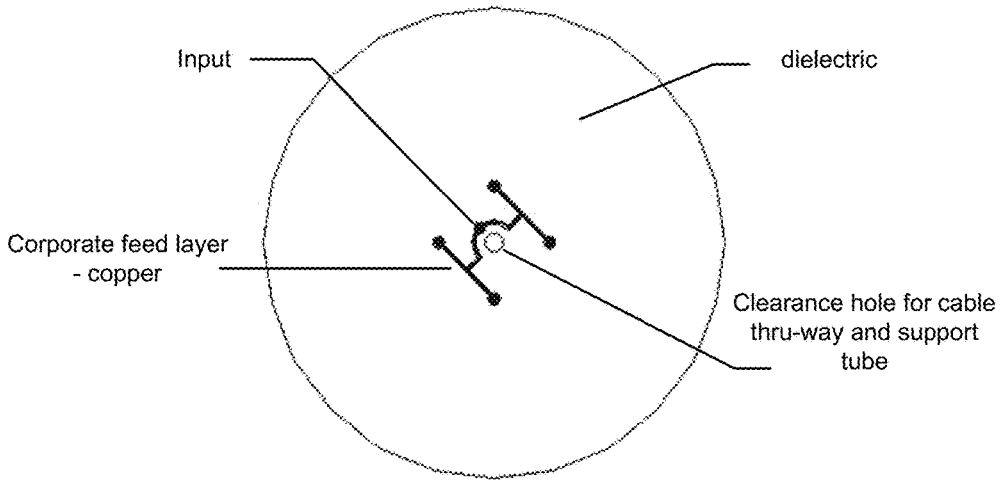
B. Corporate feed layer on one side of cu-clad laminate
Figure 2DP. Vertical polarization antenna printed circuit board

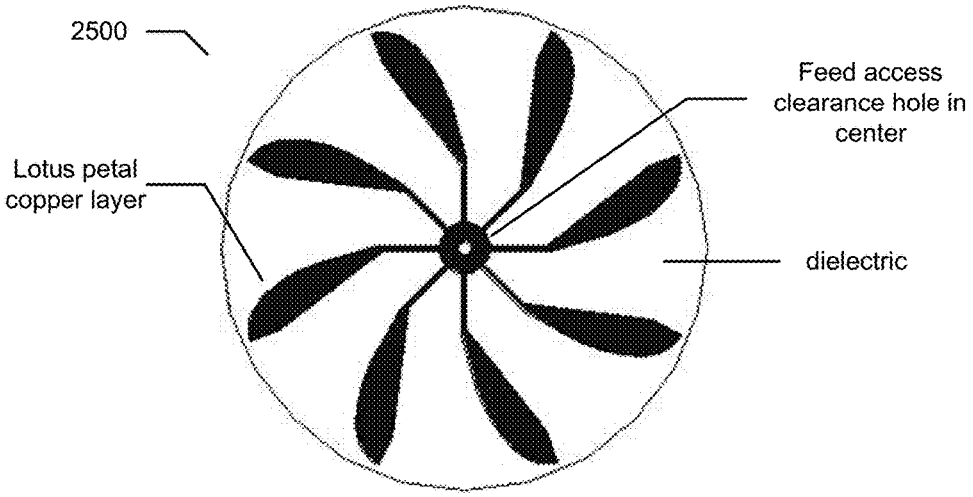
A. Lotus antenna ground layer
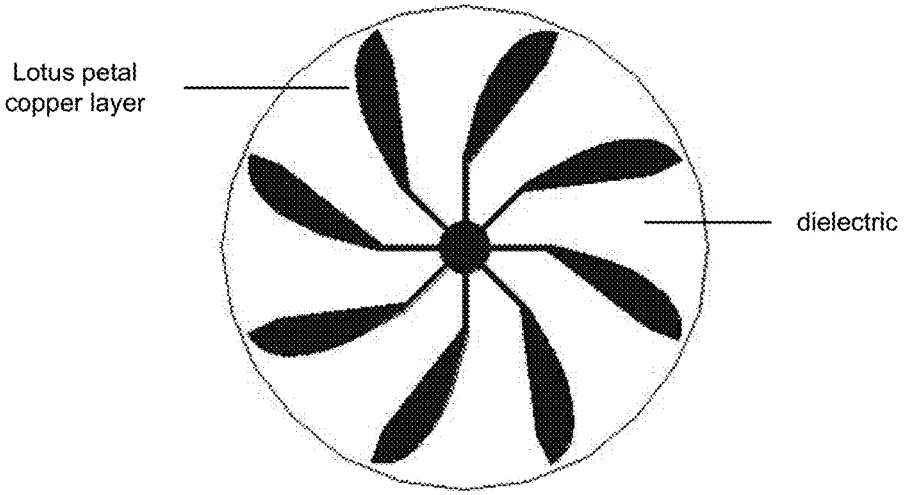
B. Lotus antenna input layer
Figure 3DP. Horizontal polarization printed circuit board

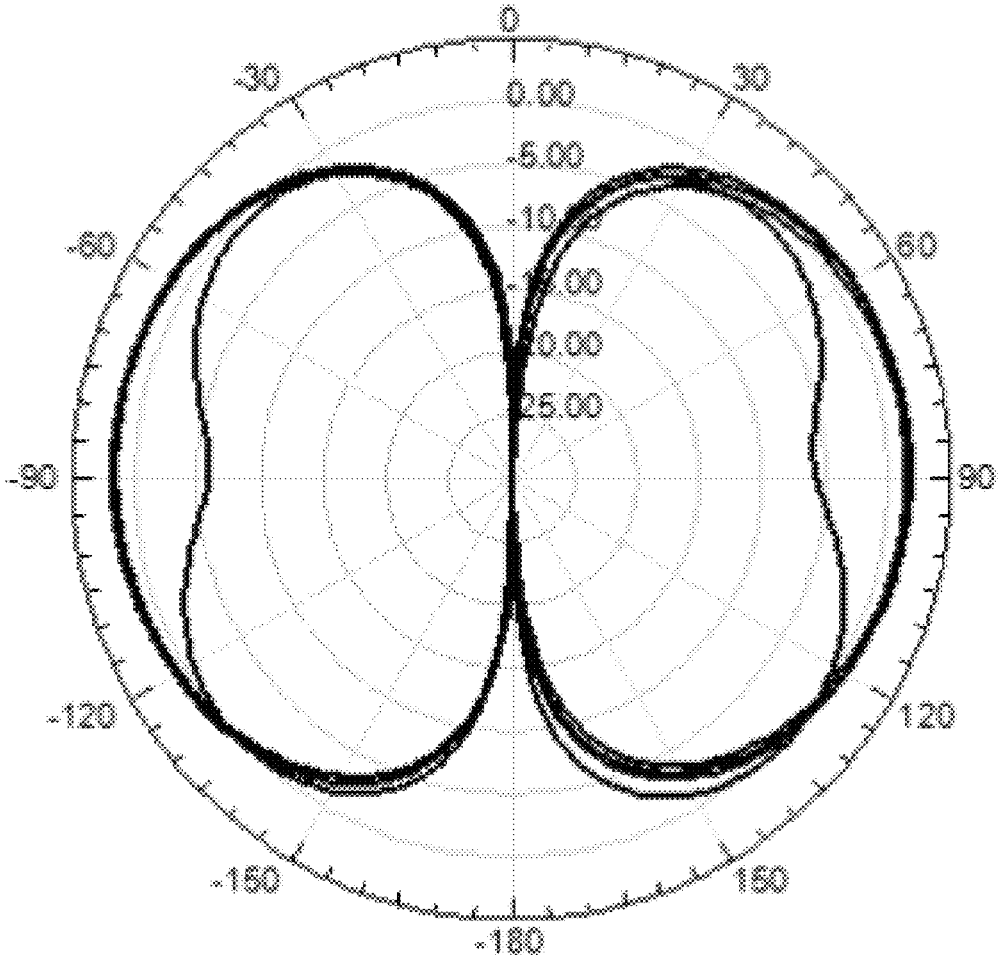
Figure 4DP. Dual Polarization Antenna
Band 1_2 Vertical Polarization Elevation Pattern

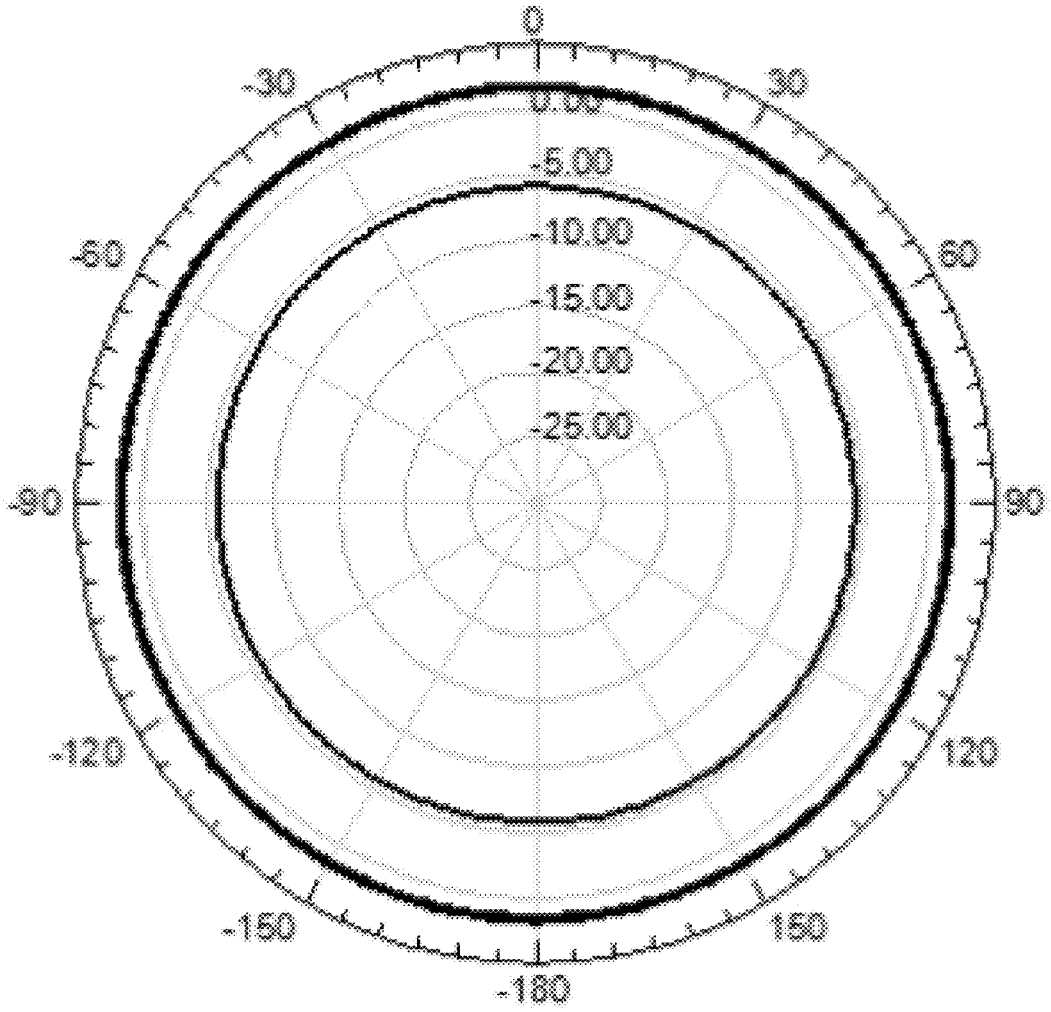
Figure 5DP. Dual Polarization Antenna
Band 1_2 Vertical Polarization Azimuth Pattern

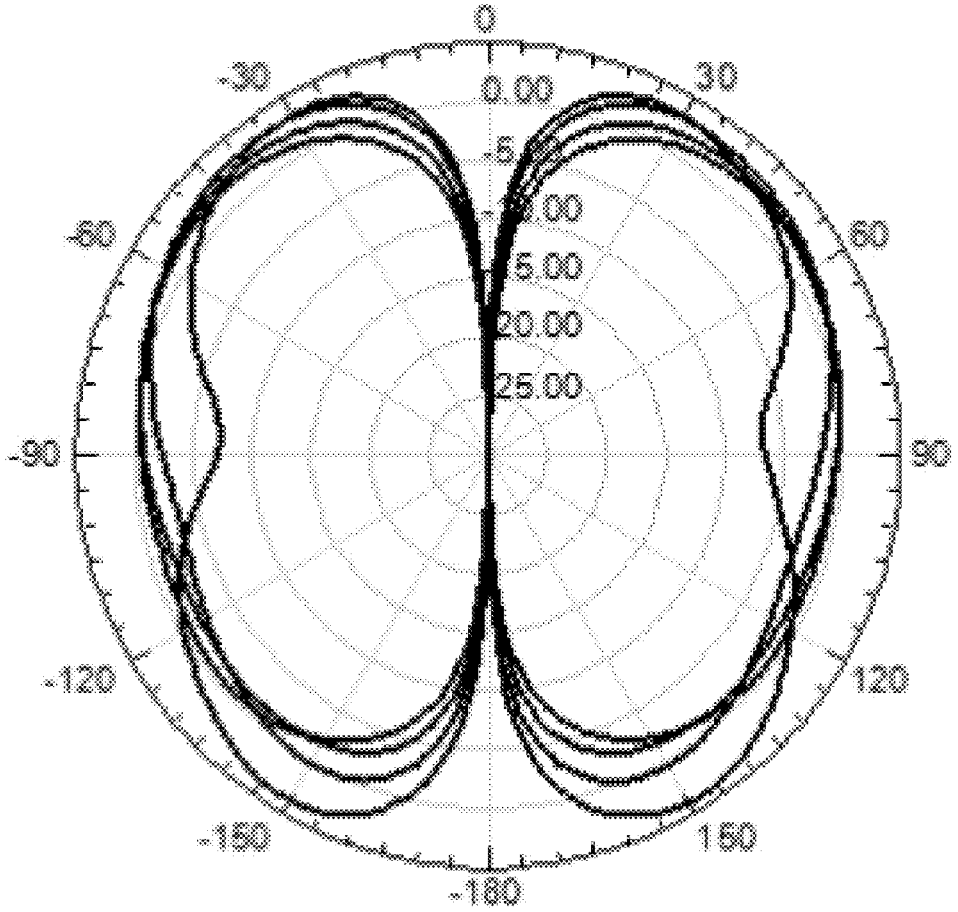
Figure 6DP. Dual Polarization Antenna
Band 3 Vertical Polarization Elevation Pattern

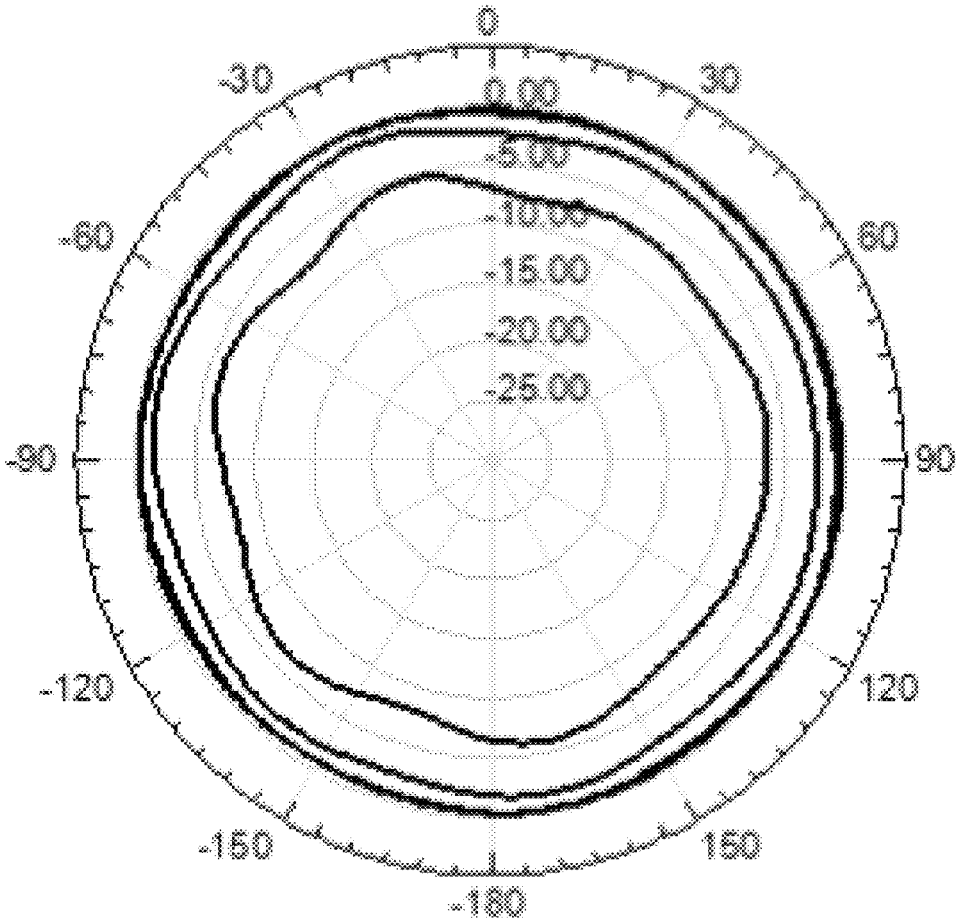
Figure 7DP. Dual Polarization Antenna
Band 3 Vertical Polarization Azimuth Pattern

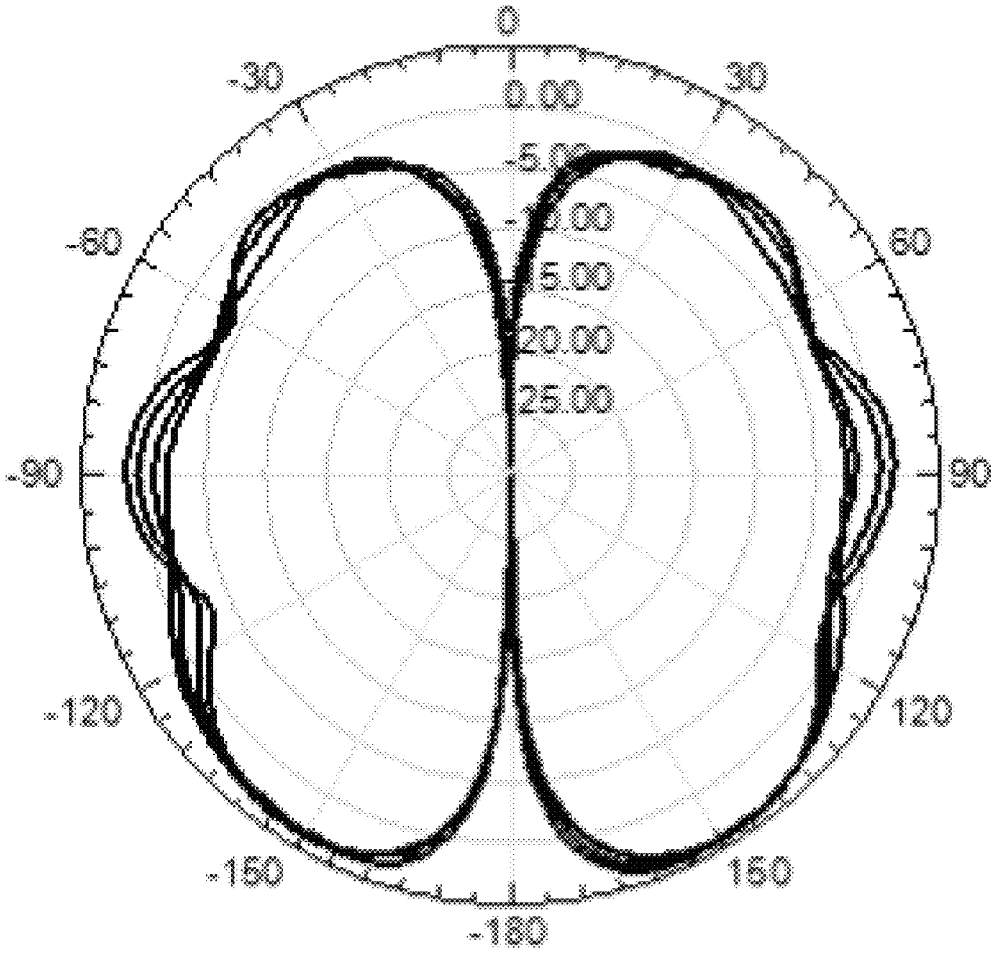
Figure 8DP. Dual Polarization Antenna
Band 4 Vertical Polarization Elevation Pattern

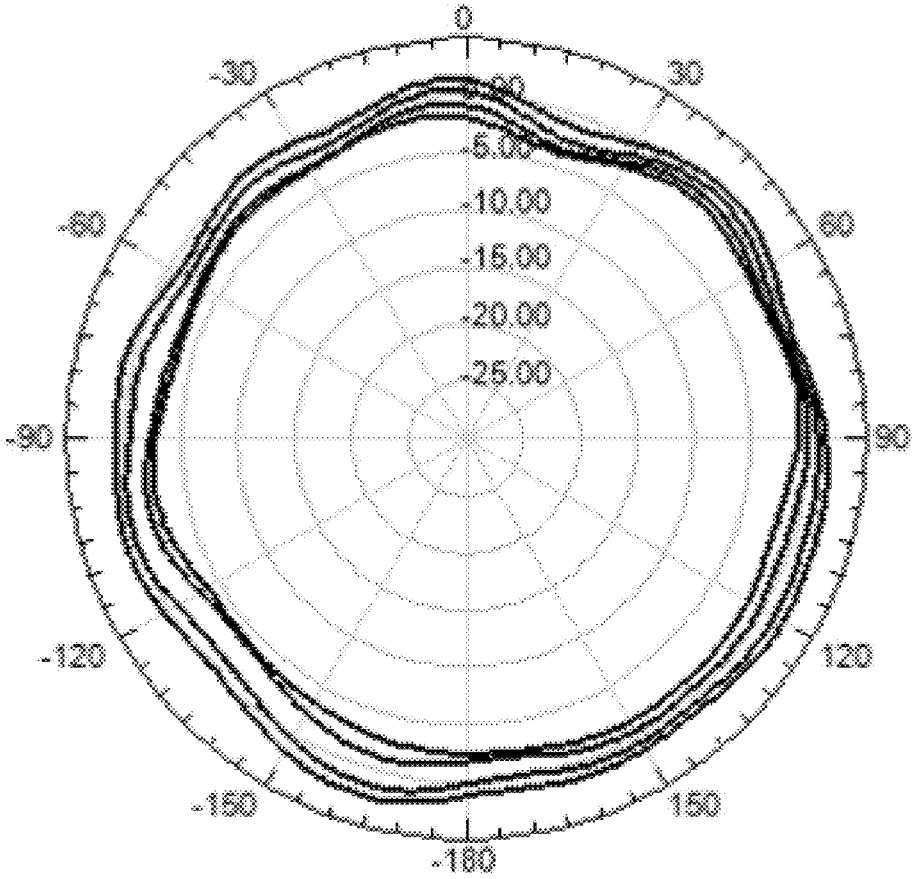
Figure 9DP. Dual Polarization Antenna
Band 4 Vertical Polarization Azimuth Pattern

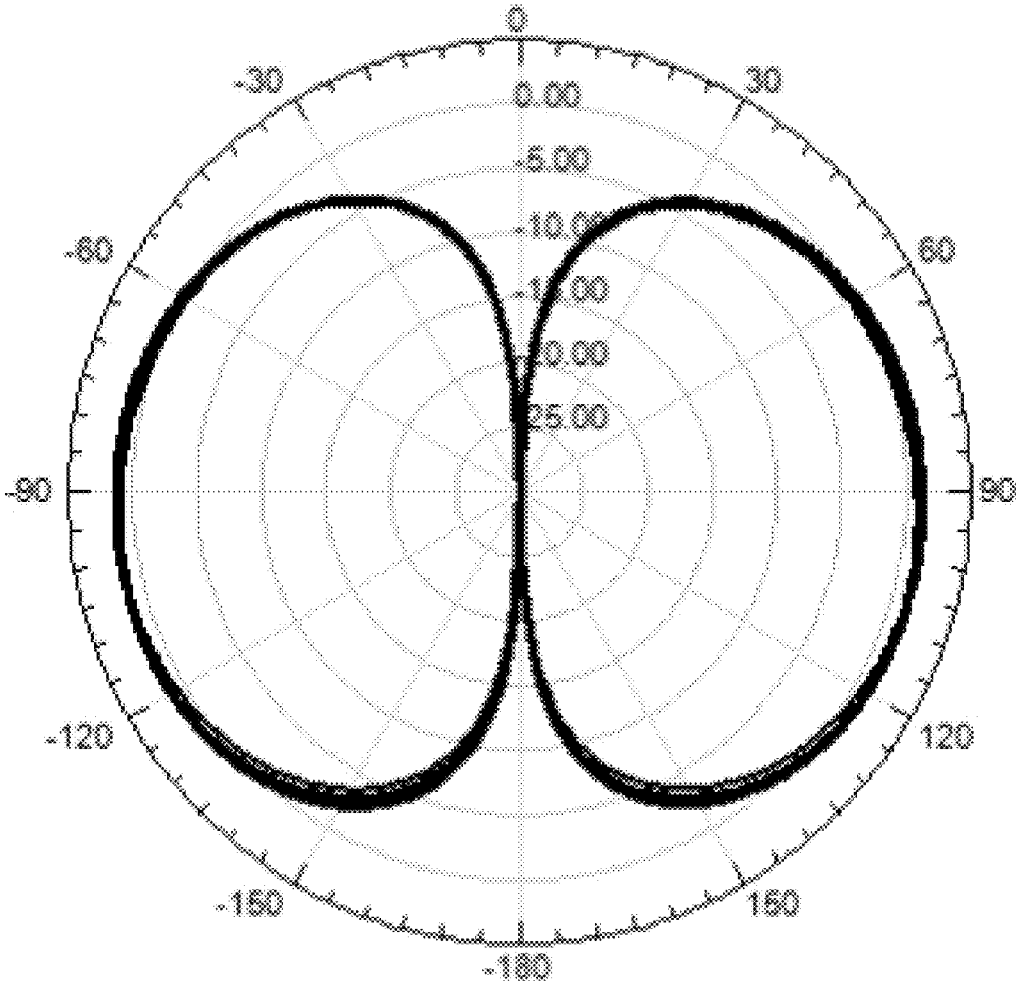
Figure 10DP. Dual Polarization Antenna
Band 1_2 Horizontal Polarization Elevation Pattern

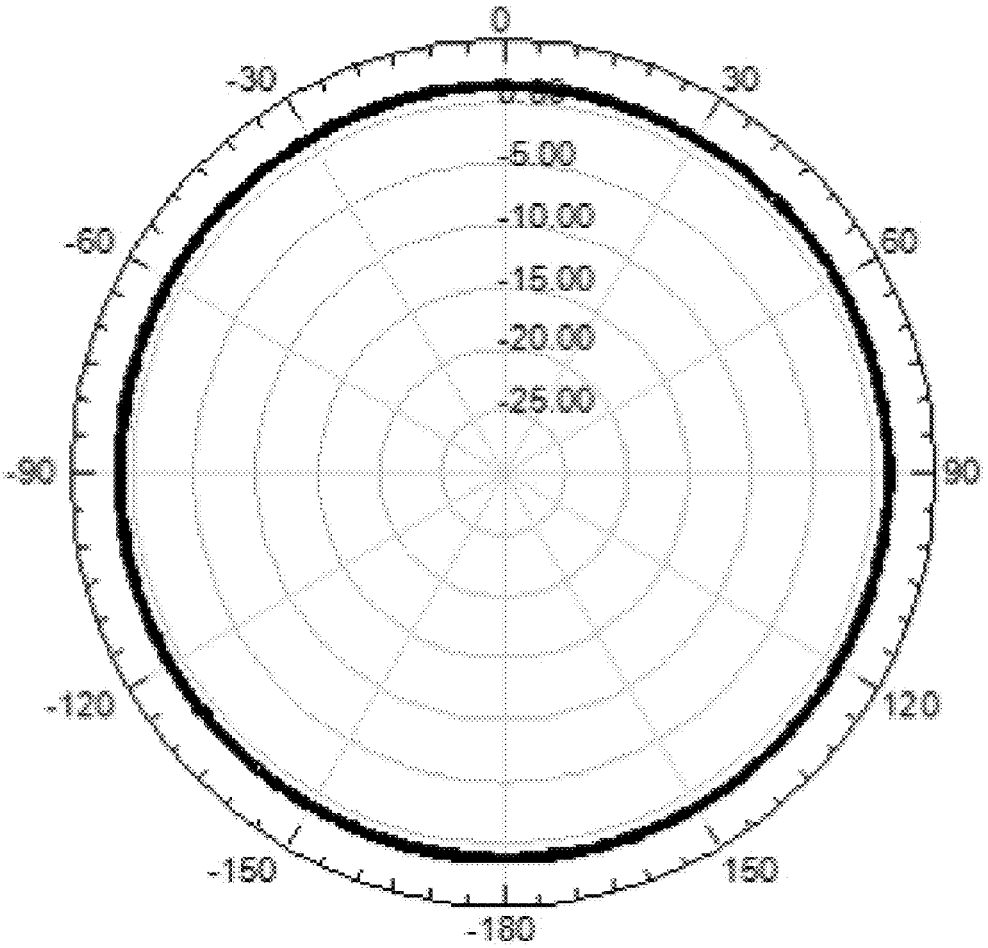
Figure 11DP. Dual Polarization Antenna
Band 1_2 Horizontal Polarization Azimuth Pattern

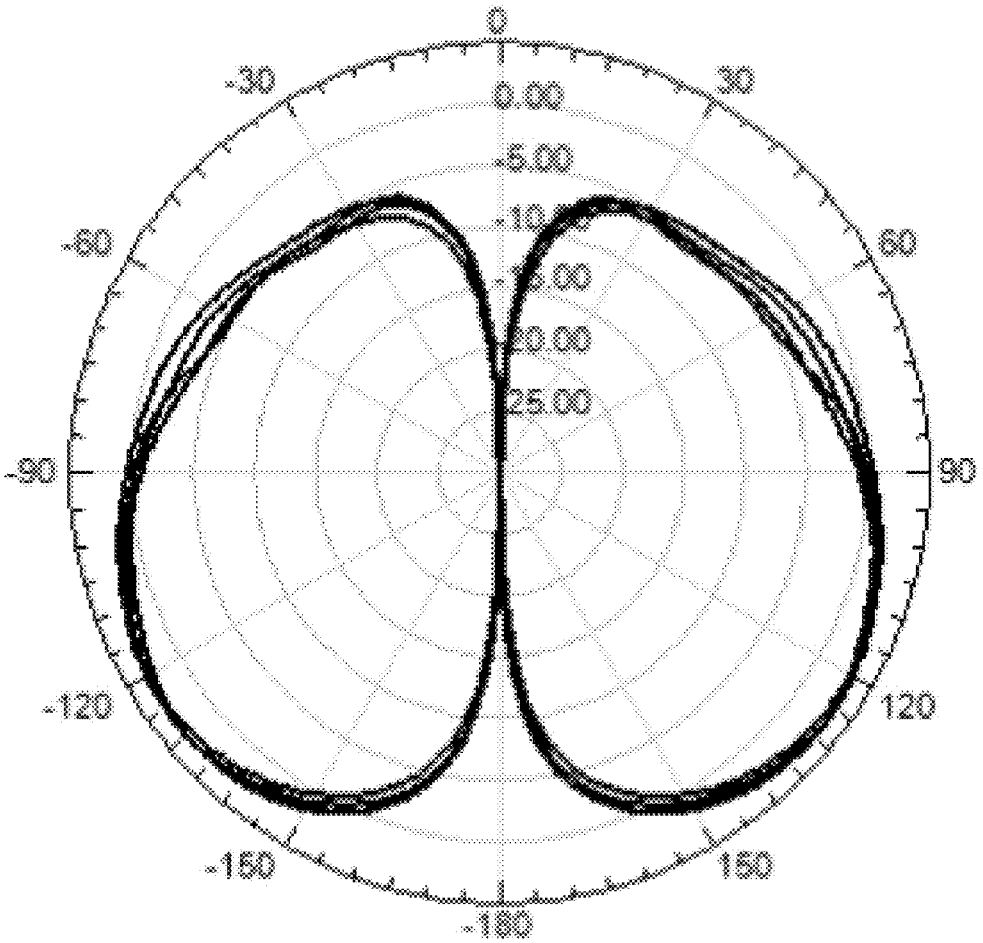
Figure 12DP. Dual Polarization Antenna
Band 3 Horizontal Polarization Elevation Pattern

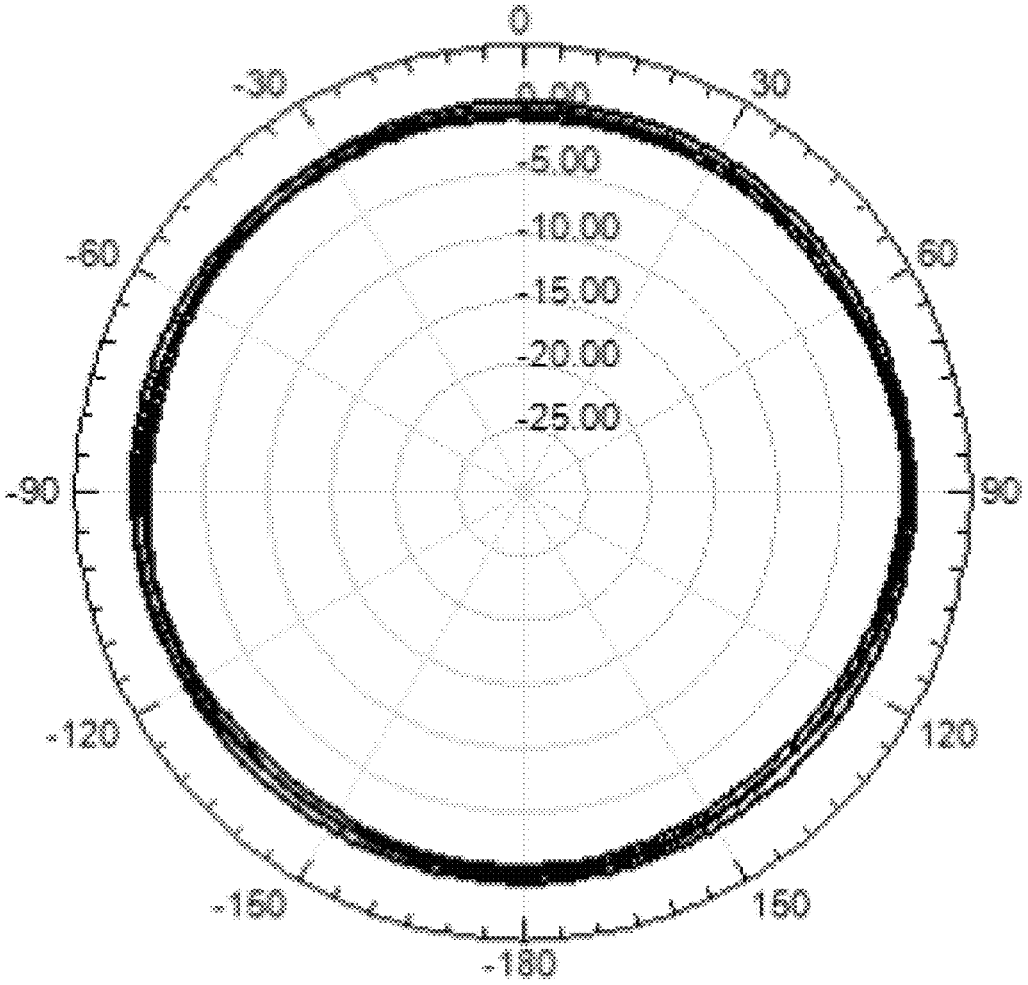
Figure 13DP. Dual Polarization Antenna
Band 3 Horizontal Polarization Azimuth Pattern

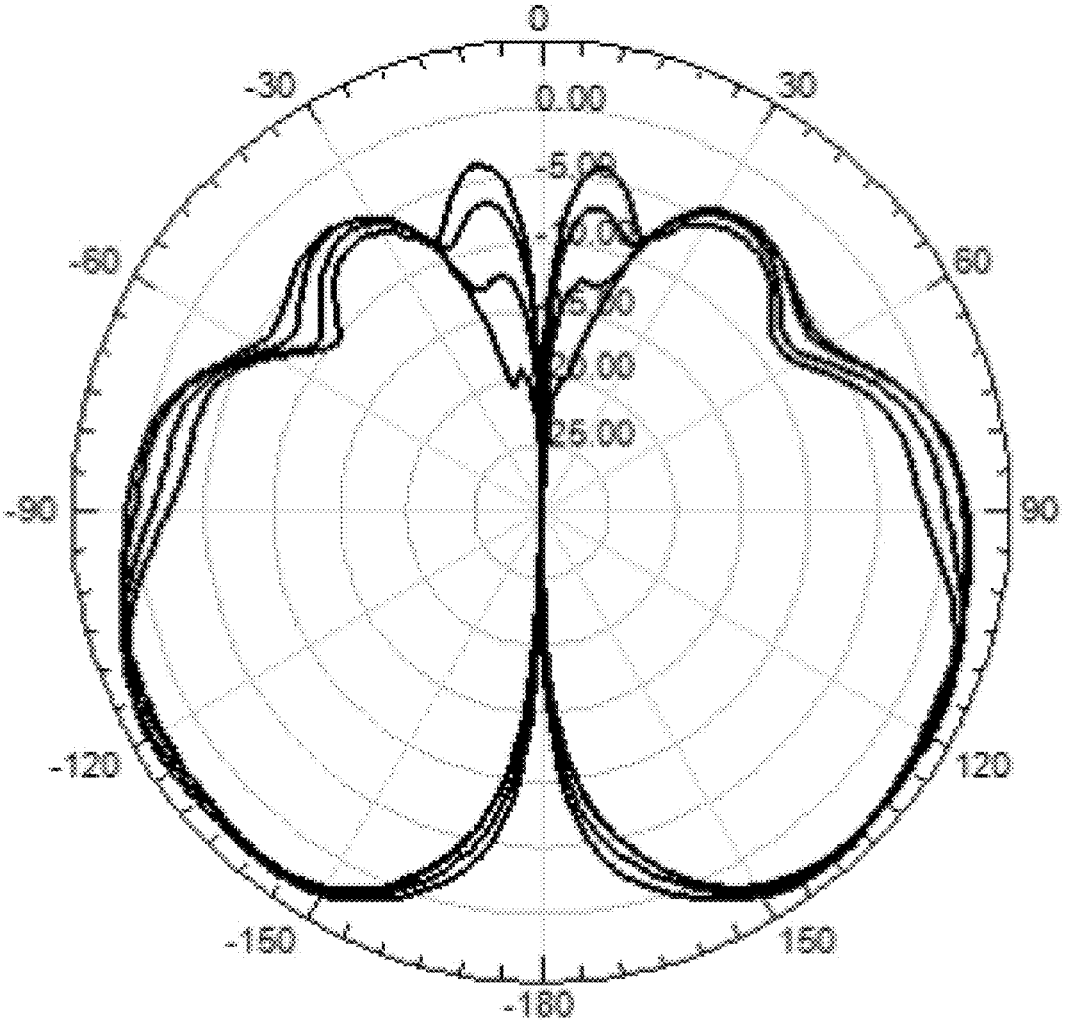
Figure 14DP. Dual Polarization Antenna
Band 4 Horizontal Polarization Elevation Pattern

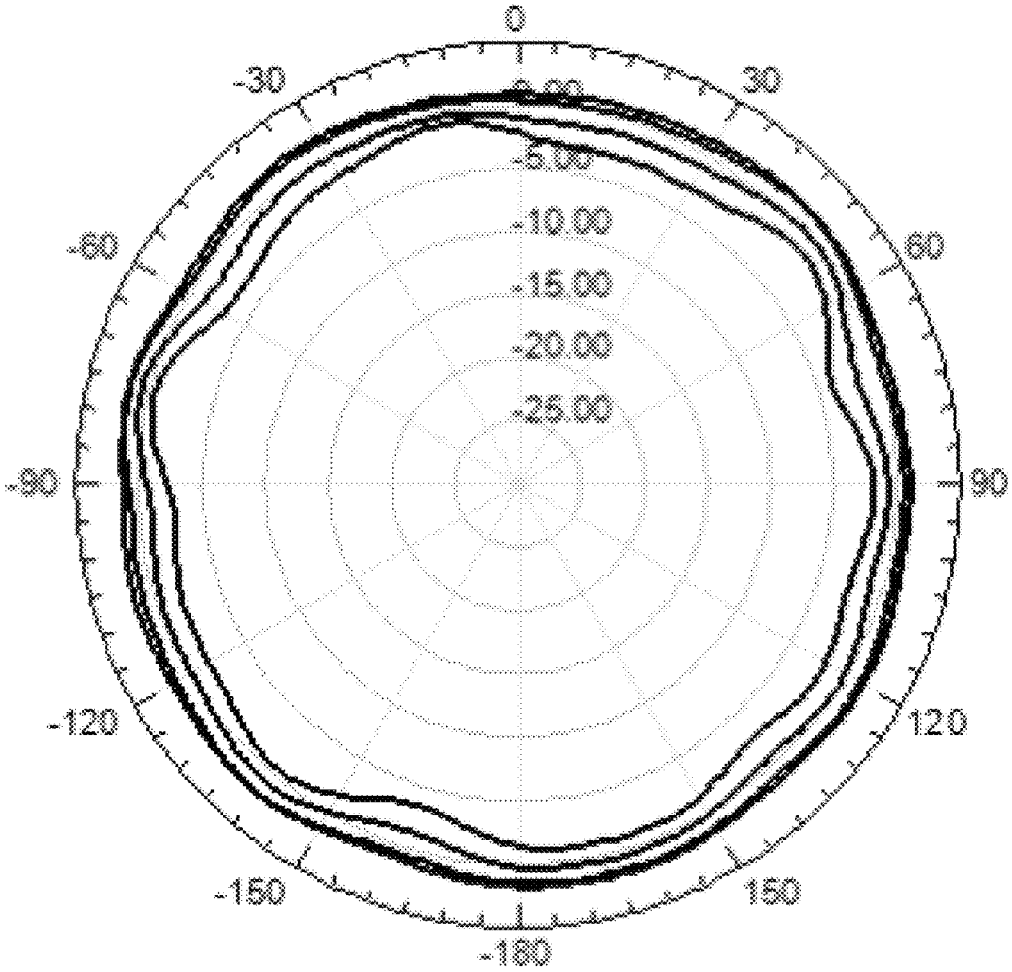
Figure 15DP. Dual Polarization Antenna
Band 4 Horizontal Polarization Azimuth Pattern

MULTI-BAND DUAL POLARIZATION OMNI-DIRECTIONAL ANTENNA

PRIORITY APPLICATION

This application claims the benefit of and priority to U.S. Provisional Patent Application No. 62/274,019, filed on Dec. 31, 2015, titled "MULTI-BAND DUAL POLARIZATION OMNI-DIRECTIONAL ANTENNA", which is incorporated herein by reference.

BACKGROUND

There is an inherent flaw to the concept, in today's profusion of wireless devices, that purports instant communication in voice and data transfer in personal, business and government intercourse. The idea that transmission of information is done at the speed of light and therefore information transfer is complete in a few milliseconds may not be entirely true. Factors such as distance, terrain, environmental conditions, equipment and frequency (as related to electromagnetic waves) are some of the elements that determine effectiveness of transmission to reception. Wireless communication has become an integral part of living in the modern world of high tech devices. Every facet of life in almost every country on the face of this earth is engaged in it. Of the critical aspect in emergency situations, civil and military, where life and death is involved, wireless communication effectiveness is of utmost importance. Of the factors mentioned above, equipment and frequency are critical to wireless communication.

The electromagnetic spectrum covers an expanse of frequencies; however, the allotment of the spectrum to wireless communication is limited to a finite band of frequencies. With the proliferation of wireless devices the allotted frequency band is becoming extremely crowded which may give rise to interference between users. Interference may become a very serious problem that may cause interruption in signal transmission and/or reception. In emergency situations, such as wild fires, hurricanes and other natural disasters, rescue operations can be adversely affected if communications are disrupted between responders and their command center. In daily situations, interruptions in personal and business communication may cause loss of information that may result in loss time and/or revenue. Accordingly, electromagnetic interference must be reduced to maintain effective communication, in a crowded and ever growing crowd of users, in a fixed finite frequency band.

SUMMARY

Example embodiments of vertical polarization antennae and horizontal polarization antennae having multi-band, omni-directional pattern characteristic are described herein. The first description is for a multi-band horizontal polarization omni-directional antenna. The second description is for a multi-band vertical polarization omni-directional antenna. The third description is for an assembly of the two orthogonally polarized antennae into a compact multi-band dual polarized omni-directional antenna.

This Summary is provided to introduce a selection of techniques in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

BRIEF DESCRIPTION OF THE DRAWINGS

The Detailed Description is set forth with reference to the accompanying figures, in which the left-most digit of a reference number identifies the figure in which the reference number first appears. The use of the same reference numbers in the same or different figures indicates similar or identical items or features.

FIG. 1H illustrates an example antenna having a "Lotus" pattern of one half of the petals in the face plane co-axially aligned with a 180° set of petals in a parallel plane behind the face plane.

FIG. 2H illustrates an example radial line excitation method of the Lotus antenna.

FIG. 3H illustrates example multiple feed feed-line configurations of the Lotus antenna.

FIG. 4H illustrates an example corporate feed excitation method of the Lotus antenna.

FIG. 5H illustrates an example edge-coupled line excitation of the Lotus antenna.

FIG. 6H illustrates an example enlarged perspective view of an edge-coupled line feed network FIG. 7H illustrates example corporate feed configurations for antennas.

FIG. 8H illustrates example methods of beam tilting.

FIG. 9H illustrates an example two-layer flared aperture horizontal polarization omni-directional antenna with a linear flare.

FIG. 10H illustrates example electrically conducting layer 1 and layer 2 of the two-layer linearly flared aperture horizontal polarization omni-directional antenna.

FIG. 11H illustrates example two-layer flared aperture horizontal polarization omni-directional antenna with a step flare.

FIG. 12H illustrates example electrically conducting layer 1 and layer 2 of the two-layer step flared aperture horizontal polarization omni-directional antenna.

FIG. 13H illustrates a simulated typical Band 1-2 far field elevation pattern with conical reflector, according to some examples.

FIG. 14H illustrates a simulated typical Band 1-2 far field azimuth pattern with conical reflector, according to some examples.

FIG. 15H illustrates a simulated typical Band 3 far field elevation pattern with conical reflector, according to some examples.

FIG. 16H illustrates a simulated typical Band 3 far field azimuth pattern with conical reflector, according to some examples.

FIG. 17H illustrates a simulated typical Band 4 far field elevation pattern with conical reflector, according to some examples.

FIG. 18H illustrates a simulated typical Band 4 far field azimuth pattern with conical reflector, according to some examples.

FIG. 1V illustrates an assembly side view of a six feed vertical polarization parallel plate antenna, according to some examples.

FIG. 2V illustrates top views of the layers of a six feed vertical polarization parallel plate antenna, according to some examples.

FIG. 3V illustrates a side view of an assembly of a four ridge vertical polarization parallel plate antenna, according to some examples.

FIG. 4V illustrates top views of the layers of a four ridge vertical polarization parallel plate antenna, according to some examples.

FIG. 5V illustrates an assembly side view of an eight double ridge vertical polarization parallel plate antenna, according to some examples.

FIG. 6V illustrates top views of the layers of an eight double ridge vertical polarization parallel plate antenna, according to some examples.

FIG. 7V illustrates upper and lower ridge configurations for an eight double ridge design, according to some examples.

FIG. 8V illustrates an assembly side view of a four fin-line vertical polarization parallel plate antenna, according to some examples.

FIG. 9V illustrates side and top views of the fin-line configuration, according to some examples.

FIG. 10V illustrates a perspective view of the corporate feed and fin-line configuration, according to some examples.

FIG. 11V illustrates a simulated typical far field Band 1-2 elevation pattern for a six feed parallel plate vertical polarization antenna, according to some examples.

FIG. 12V illustrates a simulated typical far field Band 1-2 azimuth pattern for a six feed parallel plate vertical polarization antenna, according to some examples.

FIG. 13V illustrates a simulated typical far field Band 3 elevation pattern for a six feed parallel plate vertical polarization antenna, according to some examples.

FIG. 14V illustrates a simulated typical far field Band 3 azimuth pattern for a six feed parallel plate vertical polarization antenna, according to some examples.

FIG. 15V illustrates a simulated typical far field Band 4 elevation pattern for a six feed parallel plate vertical polarization antenna, according to some examples.

FIG. 16V illustrates a simulated typical far field Band 4 azimuth pattern for a six feed parallel plate vertical polarization antenna, according to some examples.

FIG. 17V illustrates a simulated typical far field Band 1-2 elevation pattern for a four single ridge parallel plate vertical polarization antenna, according to some examples.

FIG. 18V illustrates a simulated typical far field Band 1-2 azimuth pattern for a four single ridge parallel plate vertical polarization antenna, according to some examples.

FIG. 19V illustrates a simulated typical far field Band 3 elevation pattern for a four single ridge parallel plate vertical polarization antenna, according to some examples.

FIG. 20V illustrates a simulated typical far field Band 3 azimuth pattern for a four single ridge parallel plate vertical polarization antenna, according to some examples.

FIG. 21V illustrates a simulated typical far field Band 4 elevation pattern for a four single ridge parallel plate vertical polarization antenna, according to some examples.

FIG. 22V illustrates a simulated typical far field Band 4 azimuth pattern for a four single ridge parallel plate vertical polarization antenna, according to some examples.

FIG. 1DP illustrates an example of a multiband dual polarization omni-directional antenna assembly, according to some examples.

FIG. 2DP illustrates a vertical polarization antenna printed circuit board, according to some examples.

FIG. 3DP illustrates a horizontal polarization antenna printed circuit board, according to some examples.

FIG. 4DP illustrates a simulated far field Band 1-2 vertical polarization elevation pattern for a dual polarization antenna, according to some examples.

FIG. 5DP illustrates a simulated far field Band 1-2 vertical polarization azimuth pattern for a dual polarization antenna, according to some examples.

FIG. 6DP illustrates a simulated far field Band 3 vertical polarization elevation pattern for a dual polarization antenna, according to some examples.

FIG. 7DP illustrates a simulated far field Band 3 vertical polarization azimuth pattern for a dual polarization antenna, according to some examples.

FIG. 8DP illustrates a simulated far field Band 4 vertical polarization elevation pattern for a dual polarization antenna, according to some examples.

FIG. 9DP illustrates a simulated far field Band 4 vertical polarization azimuth pattern for a dual polarization antenna, according to some examples.

FIG. 10DP illustrates a simulated far field Band 1-2 horizontal polarization elevation pattern for a dual polarization antenna, according to some examples.

FIG. 11DP illustrates a simulated far field Band 1-2 horizontal polarization azimuth pattern for a dual polarization antenna, according to some examples.

FIG. 12DP illustrates a simulated far field Band 3 horizontal polarization elevation pattern for a dual polarization antenna, according to some examples.

FIG. 13DP illustrates a simulated far field Band 3 horizontal polarization azimuth pattern for a dual polarization antenna, according to some examples.

FIG. 14DP illustrates a simulated far field Band 4 horizontal polarization elevation pattern for a dual polarization antenna, according to some examples.

FIG. 15DP illustrates a simulated far field Band 4 horizontal polarization azimuth pattern for a dual polarization antenna, according to some examples.

DETAILED DESCRIPTION

Antennae are electro-mechanical devices. Their designs, by and large, may be determined by the end-user specifications including operational frequencies, desired radiation characteristics, polarization, size and shape. An end-user requiring multiple frequency bands and polarizations may have no other choice but to select two or more antenna units to cover the frequency bands of interest. This, unfortunately, may introduce conflicts in available "real estate", costs and antenna performance degradation due to electro-magnetic interference between adjacent antennae. Investigation into mitigating the problems mentioned yielded several novel approaches to compact multi-frequency band, vertical and horizontal polarization antennae. Combining one each of the orthogonally polarized antenna may result in a compact, unobtrusive, single unit Multiband Dual Polarization Omni-directional Antenna (MBDPOA). Until recently, no compact multi-band dual polarized omni-directional antenna has been commercially available. U.S. Pat. No. 8,203,500, by inventors Royden M. Honda and Robert J. Conley entitled "Compact Circularly Polarized Omni-directional Antenna" and U.S. Pat. No. 9,184,507, by inventors Royden M. Honda, Robert J. Conley and Jon Thorpe entitled "Multi-Slot Common Aperture Dual Polarized Omni-directional Antenna" are herein incorporated by reference in their entirety. Herein are various embodiments of subsequently developed multi-band omni-directional antennae having a number of additional features discussed below.

Multi-Band Horizontal Polarization Omni-Directional Antenna

Introduction

Antennae emanating electric field vectors parallel to a plane defined by the surface of the earth is said to be horizontally polarized. In example embodiments, a horizontally polarized antenna may be mounted or operated with the vertical axis of the antenna (e.g. a vertical axis normal to the plane containing the antenna element) being substantially perpendicular to a plane defined by the surface of the earth, and still emanate an electric field that is parallel to the surface of the earth. Use of horizontal polarization may improve communications reliability by reducing interference from predominantly vertically polarized signals in overlapping and adjacent frequency bands.

Compact multi-band horizontally polarized omni-directional antennae have not proliferated in the marketplace. Herein, various embodiments include a planar compact multi-band (e.g. frequency bandwidth greater than two octaves) horizontally polarized omni-directional antenna.

Electrical Considerations

Embodiments of a multi-band horizontally polarized omni-directional antenna having a perimeter that may be substantially circular, substantially polygonal, substantially square, substantially rectangular or substantially elliptical are described herein.

Although this disclosure discusses an 8-element array within a circular perimeter, the number of elements may vary from 2 to n, where n denotes the number of elements that can be accommodated within a perimeter having a shape described above. Each of the elements may be spaced judiciously and excited appropriately to maintain correct relative amplitude and relative electrical phase from one element to an adjacent element. This enables the resultant vector sum of the emanating electric field to produce a well-behaved far field, generally circular (omni-directional), pattern in the plane normal to the axis of the antenna. Herein, a top view of an antenna may refer to a view looking perpendicularly onto a plane of the antenna. For example, such a plane of an antenna may be transmission petals, electrically conductive plates, and so on. To achieve the well behaved condition as defined below, the number of elements for a given perimeter shape may depend on the 3 decibel (dB) below pattern peak gain beam width (half-power beam width). The half-power beam width is defined to be the angle subtended by the chord, of the sector, between half power points of the far field gain pattern. To meet the definition of well behaved, the cross-over points of a pattern with adjacent patterns should be equal to or less than 3 dB from the highest peak gain. Determination of the number of elements required to meet the well behaved condition may be done at the highest operational frequency since, generally, for a given aperture the beam width decreases as frequency increases.

Well-behaved, in the context of this disclosure, is defined to mean that the ripple (variation from crest to trough) in the generally circular pattern is less than or equal to 3 dB. As an example, a well-behaved far field generally circular (omni-directional) pattern in the plane normal to the axis of the antenna yields a maximum to minimum gain variation in omni-directionality of the antenna of less than or equal to 3 dB.

FIG. 1H illustrates an example "LOTUS" multi-band horizontal polarization omni-directional antenna. The antenna arrangement is so named because of reminiscence of depictions of lotus blossoms in early Asian arts. The electrically conducting black petal pattern layer may be contained in a plane located in the foreground. The white petal pattern layer may be a 180° rotated version (mirror image) of the electrically conducting petal black pattern layer and may be located in a plane directly behind and spaced a distance away from the foreground plane with their axes coaxially aligned. FIG. 2H illustrates the two planes containing the electrically conducting petal layers of the Lotus separated and juxtaposed. The top figure of FIG. 2H may be called the input layer and the bottom figure may be called the ground layer.

As an example, a coaxial transmission line (coax) may be used to excite the Lotus antenna. The outer conductor of the coax may be terminated and conjoined to the electrically conducting ground layer. A clearance hole may be cut into the ground layer so the center conductor of the coax is able to pass through and may be terminated and conjoined to the electrically conducting input layer. When a signal is sent through the coax line an electric field may be set up in the space between the central circular areas of both parallel conducting petal layers. The electric field travels outward from the central circular areas and along the straight section of the petal which may be a broadside coupled parallel transmission line. The electric field vector may be confined in the space between the parallel lines and are normal to the inside surfaces of the lines. At the juncture where the input layer petal and ground layer petal starts to curve in opposite directions (flare of the aperture) the electric field vector begins to change its orientation and the broadside coupled parallel transmission line begins to transform into a curving off-set edge coupled line (e.g., the pair of lines that make up the edge coupled line are not contained in the same plane). FIGS. 3HA and 3HC illustrate the two types of line. The tightly coupled waves on the transmission line becomes less constrained as the flare widens and becomes very loosely coupled as it travels along the flare and eventually breaks loose from the electrically conducting surfaces and radiates into free space.

FIG. 3H illustrates cross-sectional views of the transmission lines integral to the Lotus antenna design and approximate representation of the E field vectors of the electromagnetic wave. In the transmission line types depicted the electromagnetic wave propagating along the line is called transverse electromagnetic wave (TEM) or principal wave. TEM waves do not have cut-off properties; hence, they are not frequency dependent within transmission line design parameters. Selection of this method of exciting the Lotus antenna was to achieve frequency bandwidth greater than two octaves.

FIG. 4H illustrates an alternate method of exciting the Lotus antenna. The power distribution to each of the radiating element may be accomplished by incorporating power dividers to distribute the input power to each of the radiating element. The resulting network of power dividers is called a corporate feed and is commonly used in the excitation of linear and planar antenna arrays. In the case of the Lotus the corporate feed employs equal (3 dB) power dividers and equal line lengths to each of the radiating elements resulting in a uniform amplitude and in-phase illumination of the aperture around the circularly distributed elements. The input may be placed away from the center to free the center area for a mounting tube or an RF cable (or combination of both) to pass through the petal layers. If there is no need for freeing the central area the input can be placed in the center of the Lotus. The power splitter at the input may be microstrip and converts to a broadside coupled line at the rim of the central circular ground and subsequently transitions to off-set edge coupled lines, as described previously, at the onset of the diverging tapers.

FIG. 5H illustrates a six element Lotus with electrically conducting petals, both input and ground, on the antenna layer excited by edge coupled transmission lines. The ground petals are joined together with a small diameter circular pad with a clearance hole in the center to allow a feed line access to the input feed splitter on the input layer. The input feed splitter may be located in a plane parallel to the antenna layer plane, coaxially aligned and spaced a distance behind the antenna layer plane. The electrically conducting ground terminates at, and may be conjoined to, the ground petal circular pad. The feed line continues beyond the antenna layer and terminates at, and may be conjoined to, the input feed splitter. The input petal straight section does not extend to the center but terminates a distance from the ground petal circular pad. FIG. 6H is an enlarged perspective view of the feed splitter and part of the edge coupled transmission line network. The feed splitter has short rectangular sections having the same width as, and aligned with, the input petal straight section. Continuity from the feed splitter to the input petal may be accomplished by an electrically conducting shunt pin.

An alternate arrangement for the edge coupled line excitation of the Lotus antenna is to interchange the antenna layer and the input layer. The petal and splitter functions are also interchanged (i.e., the ground petal becomes the input petal) with the ground (formerly input) splitter having the clearance hole instead of the input (formerly ground) petal circular pad. Ground continuity may be accomplished, identically as described previously, by an electrically conducting shunt pin.

FIG. 7H illustrates examples of corporate feed configurations that may be used to excite antenna elements arrayed in any of the perimeter shapes mentioned at the beginning of this section. In using the radial line or corporate feed configuration to excite arrays in a rectangular or elliptical perimeter, as examples, line lengths may require adjustment for elements closer to the feed center than elements furthest away from the feed center. FIG. 7HB illustrates a method that may be used to lengthen a line. A line extension equivalent to the difference of the line length to the furthest element and the line length to an element closer to the feed center may be inserted into the latter line to bring both line lengths to equivalence.

FIG. 8H illustrates the use of an electrically conducting reflector to alter the far field radiation pattern. If the antenna is to be mounted onto the ceiling of a room, the reflector may be used to minimize the elevation pattern gain above the horizon. The reflector depicted in FIG. 8HA and FIG. 8HB is circular in cross-section with approximately the same diameter as the Lotus antenna perimeter. For any other antenna perimeter shape, the cross-section of the reflector may take on that shape.

The Lotus is one of several variations of a two-layer flared aperture horizontal polarization omni-directional antenna. The flare in the Lotus may be a circular arc, an elliptic arc, a piecewise linear arc or a stepped arc. The foregoing analysis was for a Lotus having an elliptic arc flare. FIG. 9H illustrates a two-layer flared aperture with a linear flare. FIG. 10H illustrates the electrically conductive surfaces, layer 1 and layer 2, of the two-layer linear flared aperture antenna within a circular perimeter. FIG. 11H illustrates a two-layer flared aperture horizontal polarization omni-directional antenna with a step flare. FIG. 12H illustrates the electrically conductive surfaces, layer 1 and layer 2, of the two-layer step flared aperture antenna within a circular perimeter. The antenna illustrated in FIG. 5H may also utilize the various flare geometries.

Simulation Results

Simulations were conducted using a high frequency electromagnetic simulation program. Models of the three described embodiments of the Lotus were simulated over four bands of frequencies. Band 1-2: 690 MHz-960 MHz, Band 3: 1700 MHz-2150 MHz, and Band 4: 2450 MHz-2750 MHz. Band 1-2 covers two bands which had over lapping frequencies hence, for expediency, the 1-2 notation. The circular perimeters for all three models were approximately 5 inches in diameter. For convenience of converting from simulation models to prototype hardware, the models simulated electrically conducting surfaces of the Lotus to be copper etched from a 0.06 inch copper-clad (cuclad) laminate. The simulation antenna model was drawn with axis coaxially aligned with the z-axis of the 3-Dimensional coordinate system. The x-y plane is the horizontal plane.

Far field directivity patterns for several frequencies within each band were superimposed. FIG. 13H, FIG. 15H and FIG. 17H are elevation directivity patterns. FIG. 14H, FIG. 16H and FIG. 18H are azimuth directivity patterns at 90° elevation (plane parallel to the earth). The simulated patterns were for the Lotus with a conical reflector. The directivity patterns without the reflectors for all frequency bands are typically very similar to FIG. 13H and FIG. 14H, so are not included. Band1-2 elevation and azimuth directivity patterns, due to the size of the reflector relative to wavelength, are not appreciably affected. FIGS. 10H, 12H and 14H the far field azimuth directivity patterns, even with the reflector, represent well-behaved substantially omni-directional patterns (i.e., generally circular), with very little maximum to minimum gain variation (e.g., crest to trough ripple) in omni-directionality. As such, as an example, the antennae described herein may exhibit far field azimuth patterns that are omni-directional with a maximum to minimum gain variation in omni-directionality of less than or equal to 3 dB.

Multi-Band Vertical Polarization Omni-Directional Antenna

Introduction

Antennae emanating electric field vectors vertical to a plane defined by the surface of the earth is said to be vertically polarized. In example embodiments, this disclosure describes a vertically polarized antenna that may be mounted or operated with the vertical axis of the antenna (e.g. a vertical axis normal to the plane containing the antenna element) being substantially vertical to a plane defined by the surface of the earth, and still emanate an electric field that is vertical to the surface of the earth.

Compact multi-band vertically polarized omni-directional antennae have not proliferated in the marketplace. The present application discloses various embodiments of a planar compact multi-band (e.g. frequency bandwidth greater than two octaves) vertically polarized omni-directional antenna.

Electrical Considerations

Exemplary embodiments of a multi-band vertically polarized omni-directional antenna having a perimeter that may be substantially circular, substantially polygonal, substantially square, substantially rectangular or substantially elliptical are described herein.

Although this disclosure discusses a 8-feed parallel plate antenna within a circular perimeter, the number of feed-elements may vary from 1 to n, where n denotes the number of feed-elements that may be utilized to achieve a far field, generally circular (omni-directional), pattern in the plane normal to the axis of the antenna. The number of feeds may vary depending on the size of the parallel plates within a perimeter having a shape described above. Each of the feeds may be spaced judiciously and excited appropriately to maintain correct relative amplitude and relative electrical phase from one feed to an adjacent feed. This enables the resultant vector sum of the emanating electric field to produce a well-behaved far field, generally circular (omni-directional), pattern in the plane normal to the axis of the antenna. To achieve the well behaved condition as defined below, the number of feeds for a given perimeter shape may depend on the 3 decibel (dB) below pattern peak gain beam width (half-power beam width). To meet the definition of well behaved, the cross-over points of a pattern with adjacent patterns should be equal to or less than 3 dB from the highest peak gain. Determination of the number of elements required to meet the well behaved condition may be done at the highest operational frequency since, generally, for a given aperture the beam width decreases as frequency increases.

FIG. 1V illustrates an example parallel plate multi-band vertical polarization omni-directional antenna. The antenna arrangement may be three layered. The electrically conducting top plate may be contained in layer one (top layer). The electrically conducting corporate feed may be located in layer two (interior layer) and spaced a distance away from the top layer with their axes coaxially aligned. The electrically conducting lower plate may be in layer three (lower layer) and its axis may be aligned with that of the top and interior layers and spaced a distance away from the interior layer. Electrically conducting pins (feed pins) are conjoined to the corporate feed and to the lower plate. An electrically conducting tube (transmission line thru-way) runs through the center of the layers providing access for a transmission line to another antenna below. Additionally, the tube may be conjoined to the top and lower plates providing mechanical support for the plates. FIG. 2V illustrates the top views of the vertical polarization parallel plate antenna. FIG. 2VA illustrates the top layer and FIG. 2VB illustrates the lower layer with the corporate feed layer superimposed to show the orientation of the feed pins about the center.

As an example, a coaxial transmission line (coax) may be used to excite the parallel plate antenna. The outer conductor of the coax may be terminated and conjoined to the electrically conducting top layer. A clearance hole may be cut into the top layer so the center conductor of the coax is able to pass through and is terminated and conjoined to the electrically conducting corporate feed layer. When a signal is sent through the coax line, the electric current may be evenly distributed by the corporate feed to each of the feed pins. An electric field may be set up in the space between the top and lower conducting layers. The electric field travels radially outward from the central region to the outer edges of the plates and radiates into free space.

FIG. 3V illustrates an example assembly side view of a four single ridge vertical polarization parallel plate antenna. The electrically conducting ridges are inserted between the corporate feed layer and the lower plate and conjoined to the lower plate. The ridge alters the electric field distribution between the parallel plates in that the field may be concentrated in the space between the ridge and the top plate. For a fixed aperture width and with a sinusoidal field distribution across the aperture a certain far field pattern may be produced. Placing a ridge in the middle of the same aperture alters the field distribution across the aperture concentrating more of the field toward the center of the aperture, in effect, reducing the electrical aperture. This change in the effective electrical aperture produces a pattern with a broader beam width than the former pattern. This implies that for a given perimeter size the number of feeds needed to obtain a well behaved omni-directional pattern may be reduced with the implementation of ridges. FIG. 4V illustrates top views of the layers of a four single ridge vertical polarization parallel plate antenna. FIG. 4VA illustrates the top plate of the single ridge vertical polarization antenna. FIG. 4VB illustrates the lower layer with four single ridges and the corporate feed layer superimposed to show the orientation of the corporate feed relative to the ridges.

FIG. 5V illustrates an assembly side view of an eight double ridge vertical polarization parallel plate antenna. In this approach the corporate feed layer may be the top layer and the upper plate with the upper ridge may be the interior layer. The lower plate with the lower ridge may be the lower layer. The feed pins are conjoined to the corporate feed and passes through a clearance hole in the upper ridge and terminates and conjoined to the lower ridge. FIG. 6V illustrates top views of the layers of an eight double ridge vertical polarization parallel plate antenna. FIG. 6VA illustrates the upper plate with the corporate feed layer superimposed. FIG. 6VB illustrates the lower layer showing the locations where the feed pins are conjoined to the ridge. FIG. 7V illustrates the upper and lower ridge configurations for an eight double ridge design. FIG. 7VA illustrates the upper ridge showing the clearance hole for the transmission line thru-way support structure and the eight clearance holes for feed pin access from the corporate feed layer to the lower ridge. FIG. 7VB illustrates the lower ridge.

FIG. 8V illustrates an assembly side view of an example four fin-line vertical polarization parallel plate antenna. The antenna may be layered in the same manner as in the previously discussed parallel plate antennae. The top plate may be an electrically conducting layer. The interior layer may be the electrically conducting corporate feed and may be placed a distance away from the top plate. The third layer may be the electrically conducting lower plate. All three axes of the layers are coaxially aligned. FIG. 9VA illustrates the corporate feed and fin-lines superimposed on to the lower plate. The configuration for other than 4 fin-lines will follow the same methodology (i.e. the number of fin-lines will match the number of feed points). The fin-line may be an electrically conducting surface having a shape that may be rectangular, triangular, polygonal, circular or elliptical. FIG. 9VB illustrates the fin-line having an elliptical arc (¼ of an elliptical surface). The fin-lines are conjoined to the corporate feed and to the lower plate and may help to make it a stable structure. FIG. 10V illustrates a perspective view of the corporate feed, fin-lines and lower plate structure. The corporate feed layer is highlighted by the dashed outline.

Simulation Results

Simulations were conducted using a high frequency electromagnetic simulation program. Models of the described embodiments of the vertical polarization parallel plate antenna were simulated over four bands of frequencies. Band 1-2: 690 MHz-960 MHz, Band 3: 1700 MHz-2150 MHz, and Band 4: 2450 MHz-2750 MHz. Band 1-2 covers two bands which had over lapping frequencies hence, for expediency, the 1-2 notation. The circular perimeters for the models were approximately 5 inches in diameter. For convenience of converting from simulation models to prototype hardware, the models simulated electrically conducting surfaces of the corporate feed layer and the top plate, to be copper, etched on a 0.06 inch cuclad laminate. The lower plate was a brass disk 0.02 inch in thickness. The feed pins were 0.05 inch diameter brass wire. One model was the six feed vertical polarization parallel plate antenna shown in FIG. 1V and the other was the four single ridges vertical polarization parallel plate antenna shown in FIG. 3V. The simulated far field patterns showed similar characteristics for both models in all frequency bands. The ridges shown are solid brass blocks and are an integral part of the lower plate. The ridges, however, may be channel stock cut to size and conjoined to the lower plate or stamped as part of the lower plate. The simulation antenna model was drawn with axis coaxially aligned with the z-axis of the 3-Dimensional coordinate system. The x-y plane is the horizontal plane.

Far field directivity patterns for several frequencies within each band were superimposed. FIG. 11V, FIG. 13V and FIG. 15V are elevation directivity patterns. FIG. 12V, FIG. 14V and FIG. 16V are azimuth directivity patterns at 90° elevation (plane parallel to the earth). The simulated patterns were for the six feed parallel plate antenna. The far field directivity patterns for the four ridge parallel plate are also superimposed at the identical frequencies. FIG. 17V, FIG. 19V and FIG. 21V are far field directivity elevation patterns and FIG. 18V, FIG. 20V and FIG. 22V are azimuth directivity patterns at 90° elevation. FIGS. 12V, 14V and 16V also FIGS. 18V, 20V and 22V, far field azimuth directivity patterns for the six feed parallel plate antenna and the four single ridge parallel plate antenna, respectively, represent well-behaved substantially omni-directional patterns (i.e., generally circular), with very little maximum to minimum gain variation (e.g., crest to trough ripple) in omni-directionality. As such, as an example, the antennae described herein may exhibit far field azimuth patterns that are omni-directional with a maximum to minimum gain variation in omni-directionality of less than or equal to 3 dB.

Multiband Dual Polarization Omni-Directional Antenna

Introduction

A compact multiband dual polarization omni-directional antenna may be realized by combining the multiband horizontally polarized omni-directional Lotus and the multiband vertically polarized omni-directional parallel plate antennae discussed in the previous sections of this disclosure. Any combinations of the various embodiments of the horizontally and vertically polarized antennae may be used. The order of the antenna placement may be reversible i.e., vertically polarized antenna above the horizontally polarized antenna or, conversely, horizontally polarized antenna above the vertically polarized antenna.

Electrical Consideration

FIG. 1DP illustrates an example assembly of the multiband horizontally polarized omni-directional Lotus antenna and a multiband vertically polarized omni-directional parallel plate antenna. In this example, both antennae have circular perimeters and utilize copper clad (cuclad) laminates. FIG. 2DP illustrates the vertical polarization antenna printed circuit board (PCB). The top layer (ground layer) may be copper and the corporate feed copper layer may be etched on the opposite face of the laminate. The transmission line thru-way and support tube may be conjoined to the ground layer of the PCB and to the vertical polarization lower plate. In this example the lower plate and thru-way tube may be brass. FIG. 3DP illustrates the printed circuit board on which the Lotus petal layers are etched. The input petal layer and ground petal layer, are etched, respectively, on opposite sides of a cuclad laminate. The input layer petals are etched on the lower copper layer and the ground layer petals are etched on the upper copper layer of the cuclad laminate. The input transmission line may be a coaxial cable (coax). The input coax goes through the transmission line thru-way tube and the outer shield of the coax terminates at and may be conjoined to the ground petal layer. The center conductor of the coax continues through a clearance hole in the ground petal layer and through a clearance hole in the dielectric of the laminate and terminates at and may be conjoined to the input petal layer.

Simulation Results

Simulations were conducted using a high frequency electromagnetic simulation program. Models of the described embodiments of the Lotus horizontal polarization antenna and the vertical polarization parallel plate antenna were assembled as illustrated in FIG. 1DP. The dual polarization omni-directional antenna was simulated over four bands of frequencies. Band 1-2: 690 MHz-960 MHz, Band 3: 1700 MHz-2150 MHz, and Band 4: 2450 MHz-2750 MHz. Band 1-2 covers two bands which had over lapping frequencies hence, for expediency, the 1-2 notation. The circular perimeters for the models were approximately 5 inches in diameter. For convenience of converting from simulation models to prototype hardware, the models simulated electrically conducting surfaces of the corporate feed layer and the top plate and the Lotus petals to be copper, etched on 0.06 inch cuclad laminates. The lower plate was a brass disk 0.02 inch in thickness. The feed pins were 0.05 inch diameter brass wire. The brass transmission line thru-way and support tube was approximately 0.2 inch in diameter with the inner diameter large enough to accommodate a 0.141 semi-rigid coaxial cable. The vertical polarization parallel plate antenna was approximately 0.225 inch from outside surface of top plate to outside surface of lower plate. The Lotus was spaced approximately 1.5 inches below the lower plate. The total height of the dual polarization antenna was approximately 1.8 inches.

The simulation antenna model was drawn with axis coaxially aligned with the z-axis of the 3-Dimensional coordinate system. The x-y plane is the horizontal plane.

Far field directivity patterns for several frequencies within each band were superimposed. FIG. 4DP, FIG. 6DP and FIG. 8DP are vertical polarization elevation directivity patterns. FIG. 5DP, FIG. 7DP and FIG. 9DP are vertical polarization azimuth directivity patterns at 90° elevation (plane parallel to the earth). FIG. 10DP, FIG. 12DP and FIG. 14DP are horizontal polarization elevation directivity patterns. FIG. 11DP, FIG. 13DP and FIG. 15DP are horizontal polarization azimuth directivity patterns. There are mutual coupling effects evident in the vertical polarization antenna elevation patterns for Band 1-2 and Band 3. Comparing FIG. 4DP to FIG. 11V and FIG. 6DP to FIG. 13V a compression in amplitude for one of the patterns in Band 1-2 and Band 3 occurs. However, the compression may be not very deep and there are several parameters that can be investigated to further the decrease in the compression. The azimuth patterns for both vertical and horizontal polarizations represent well-behaved substantially omni-directional patterns (i.e., generally circular), with very little maximum to minimum gain variation (e.g., crest to trough ripple) in omni-directionality. As such, as an example, the antennae described herein may exhibit far field azimuth patterns that are omni-directional with a maximum to minimum gain variation in omni-directionality of less than or equal to 3 dB.

Mechanical Considerations

The MBDPOA may be enclosed in an RF transparent radome. For indoor applications the radome may serve as an aesthetically unobtrusive add-on and may not require a robust construction. For outdoor or mobile applications the construction of the radome may require materials that are impervious to outdoor elements (wind, rain, ice etc.). The fabrication of the antennae may be accomplished by utilizing commercially available materials, for example, sheet metal, tubing, flexible copper sheets, electrically conducting clad laminates (e.g. cuclads), plastics that may have surfaces coated to be electrically conductive and numerous others. The fabrication methods are numerous also. Some examples are stamping, molding, extrusion, laser cutting, water jet and 3-D printing. All of the above statements, including materials and fabrication methods, may be applicable to the vertical polarization and horizontal polarization antennae when used separately as individual units.

CONCLUSION

Although the subject matter has been described in language specific to structural features and/or methodological acts, it is to be understood that the subject matter defined in the appended claims is not necessarily limited to the specific features or acts described. Rather, the specific features and steps are disclosed as example forms of implementing the claims.

Conditional language such as, among others, "can," "could," "may" or "might," unless specifically stated otherwise, are understood within the context to present that certain examples include, while other examples do not include, certain features, variables and/or steps. Thus, such conditional language is not generally intended to imply that certain features, variables and/or steps are in any way required for one or more examples or that one or more examples necessarily include logic for deciding, with or without user input or prompting, whether certain features, variables and/or steps are included or are to be performed in any particular example.

Conjunctive language such as the phrase "at least one of X, Y or Z," unless specifically stated otherwise, is to be understood to present that an item, term, etc. may be either X, Y, or Z, or a combination thereof.

It should be emphasized that many variations and modifications may be made to the above-described examples, the variables of which are to be understood as being among other acceptable examples. All such modifications and variations are intended to be included herein within the scope of this disclosure and protected by the following claims.

What is claimed is:

1. A dual polarization antenna for wireless electromagnetic communications, the dual polarization antenna comprising:

a first antenna portion aligned with a second antenna portion along a vertical longitudinal axis of the dual polarization antenna, wherein;

the first antenna portion comprises a multiband flared aperture antenna that is configured to emanate a horizontally polarized substantially omni-directional electric field perpendicular to the vertical longitudinal axis of the antenna, and the second antenna portion comprises a parallel plate multiband antenna that is configured to emanate a vertically polarized substantially omni-directional electric field parallel to the vertical longitudinal axis of the antenna.

2. The dual polarization antenna of claim 1, further comprising a signal input cable adjacent to the second antenna portion, wherein the first antenna portion and the second antenna portion are separated and facing each other with an axis of the first antenna portion being collinear with an axis of the second antenna portion.

3. The dual polarization antenna of claim 2, wherein each of the multiband flared aperture antenna and the parallel plate multiband antenna has a circular perimeter.

4. The dual polarization antenna of claim 1, further comprising a signal input cable adjacent to the first antenna portion, wherein the first antenna portion and the second antenna portion are separated and facing each other with an axis of the first antenna portion being collinear with an axis of the second antenna portion.

5. The dual polarization antenna of claim 4, wherein each of the multiband flared aperture antenna and the parallel plate multiband antenna has a circular perimeter.

* * * * *